US006748788B2

(12) United States Patent
Yamano et al.

(10) Patent No.: US 6,748,788 B2
(45) Date of Patent: Jun. 15, 2004

(54) METHOD FOR BENDING METAL PLATE

(75) Inventors: Takayuki Yamano, Kakogawa (JP); Jiro Iwaya, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 10/253,879

(22) Filed: Sep. 25, 2002

(65) Prior Publication Data

US 2003/0061852 A1 Apr. 3, 2003

(30) Foreign Application Priority Data

Sep. 26, 2001 (JP) ..... 2001-292685
Sep. 27, 2001 (JP) ..... 2001-296926

(51) Int. Cl.[7] ..... B21D 5/01
(52) U.S. Cl. ..... 72/379.2; 72/306
(58) Field of Search ..... 72/312, 313, 306, 72/379.2, 356, 348, 350, 296, 414, 385

(56) References Cited

U.S. PATENT DOCUMENTS

| | | | | | |
|---|---|---|---|---|---|
| 1,688,111 | A | * | 10/1928 | Bohle | 72/349 |
| 2,966,873 | A | * | 1/1961 | Hoffman | 72/466 |
| 4,109,503 | A | * | 8/1978 | Francon et al. | 72/352 |
| 4,373,371 | A | * | 2/1983 | Liu | 72/374 |
| 4,450,706 | A | * | 5/1984 | Engelmohr | 72/385 |
| 6,474,128 | B1 | * | 11/2002 | Liu | 72/379.2 |

FOREIGN PATENT DOCUMENTS

| | | | | |
|---|---|---|---|---|
| EP | 0 055 435 | * | 7/1982 | |
| JP | 57-52523 | * | 3/1982 | 72/414 |
| JP | 4-147718 | * | 5/1992 | 72/379.2 |
| JP | 7-204743 | | 8/1995 | |
| JP | 8-174074 | | 7/1996 | |

* cited by examiner

*Primary Examiner*—Daniel C. Crane
(74) *Attorney, Agent, or Firm*—Oblon, Spivak, McClelland, Maier & Neustadt, P.C.

(57) ABSTRACT

Disclosed is a method for bending a metal plate comprising: a first forming step (A) for obtaining a first formed member having a bent portion; and a second forming step (B) for bending the first formed member in a direction of a bending direction of the bent portion so as to allow the bent portion of the first formed member to receive bending-back force. In bending a metal plate by a forming punch relatively moving to a forming die side, the metal plate is bent in an arch shape round the bent forming portion of the forming die. The angle θp formed between an inclined flat forming portion and a horizontal flat forming portion of the forming die is set to θp>0, so that the bent arch portion abuts with the inclined flat forming portion of the forming punch and the inclined flat portion of the forming die simultaneously for a certain period of time. This reduces the angle change defect of the bent portion of the formed portion, with no need of changing product shape or of preparing for a special forming die or a facility.

11 Claims, 22 Drawing Sheets

METHOD FOR BENDING METAL PLATE

BACKGROUND OF THE INVENTION

1. Field of Invention

The present invention relates to a method for forming such members made of metal plates as used for car parts and the like, and in particular, relates to a method for improving a defective shapes caused by a change of an angle of bent portion of the formed member, caused by elastic recovery when removed from a forming die.

2. Description of Related Art

In recent years, a body or a part for automobiles is increasingly stronger and lighter for mileage improvement, environmental consideration, and safety improvement. One way to achieve stronger and lighter parts is to use lighter materials such as high-tension steel or aluminum based alloy for a press-formed member of metal plates that takes a large portion of car component parts.

FIG. 1 shows a representative example of the press-formed member. FIG. 1A shows an L-shaped member formed by one edge of an upper flat portion 51 and a longitudinal flat portion 53 forming the member perpendicularly through a bent portion 52.

FIG. 1B shows a U-shaped member where the L-shaped members are placed symmetrically. FIG. 1C shows a Z-shaped member formed in a manner that on one edge of an upper flat portion 61, a longitudinal flat portion 63 is formed perpendicularly through a bent portion 62, and on the other edge thereof, a flange portion 65 is coupled through a bent portion 64 so as to be parallel to the upper flat portion 61. FIG. 1D shows a hat-channel shaped member where the Z-shaped members are placed symmetrically. These formed members are formed integrally of a metal plate by relatively displacing a forming die and a forming punch (sometimes called "bending blade") having a forming surface corresponding to a shape of the formed member.

A problem with a press forming of a metal plate of high tension steel or aluminum based alloy is that large spring-back caused when a plate is removed from the forming die, deteriorates dimensional accuracy of the formed member. Examples of the above are as follows:

FIG. 2A is a diagram in which chain double dashed lines show a shape of a U-shaped member before removed from the die (i.e., a target forming shape) and solid lines show a shape of the member after removed from the die; likewise, FIG. 2B is a diagram in which chain double dashed lines show a hat-channel shape of a member before removed from the die (i.e., a target forming shape) while solid lines show a shape of the member after removed from the die. In both cases, an angle change defect $\Delta\theta$ occurs at the bent portions 52 and 62, respectively, after the member is removed from the forming die. Note that the angle change defect $\Delta\theta$ is an angle formed between a tangent of the end of the bent portion on a longitudinal flat portion side and a longitudinal flat portion of the target forming shape. In the case of the hat-channel shaped member (the Z-shaped member), in addition to the angle change defect of the bent portion 62, the longitudinal flat portion 63 receiving bending for bending-back force warps suffers from an outward curvature. In the figure, $\Delta$ represents a maximum dividing distance between the warped portion and a line segment coupling between the end of the bent portion on the both sides of the longitudinal flat portions. The bending for bending-back force means that when a plate material bent and formed, the bent portion bends back to an opposite direction to that was bent first, and the portion that was bent back is distorted by rebounding to the first bending direction. The angle change defect and the curvature causes an opening, with an opening distance $\Delta W$, to be generated at a lower end of the longitudinal flat portion of the hat-channel shaped member. The opening distance $\Delta W$ is a horizontal distance between the lower ends of the respective longitudinal flat portions of the forming shape just removed from the die and the target forming shape. The lower end of the longitudinal flat portion of the hat-channel shaped member (and the Z-shaped member) refers to an intersecting portion extended from an inner surface of the longitudinal flat portion and a lower surface of the flange portion.

Some examples of various methods of preventing angle change defect at the bent portion of the formed member are proposed as follows.

First is a method for designing a shape of a forming die so that a formed member becomes the right size when in springback;

Second is a method in which a reverse bending radius portion having an opposite direction of the bending direction is formed along a ridge line of a bent portion, described in JP-A-7-204743.

Third is a method for giving compression stress in a direction of a plate thickness of a bent portion so as to reduce the remaining stress, described in JP-A-8-174074. Incidentally, the similar methods can be basically applied to reducing the wall curvature $\Delta$.

Problems of those methods are as follows. In the first method, it is difficult to design a forming die (a tool) in an appropriate shape, requiring more time to try and learn, which lead to increase a cost of the forming die and to delay to start producing the product. In the second method, the reverse bending radius portion needs to be added to the bent portion of the product, causing to change an appearance of the product to a poor one.

Incidentally, the reverse bending radius portion is the one that is not originally needed. In the third method, there needs additional machines other than a pressing machine, such as a device to add compressive force.

SUMMARY OF THE INVENTION

Under the circumstances, the present invention aims at solving the problems and providing a method for bending a metal plate that can reduce an angle change defect of the bent portion of the formed member with no need of changing product shape or of preparing for a special forming die or a facility.

First aspect of the present invention resides in a method for bending a metal plate, comprising:

a first forming step for obtaining a first formed member having a bent portion obtained by bending a metal plate; and a second forming step for bending the bent portion of the first formed member in the same direction as a bending direction of the bent portion, so that the bent portion of the first formed member receives bending-back force.

Second aspect resides in a method for bending a metal plate, comprising:

a first forming step for bending a metal plate by relatively moving a first forming punch from a first flat forming portion to a first forming die with a second flat forming portion formed therein, through a bent forming portion having a radius R1, to thereby obtain a first formed member in which a first flat portion and a second flat portion is coupled with each other through the thus formed bent portion by the bent forming portion; and a second forming step for relatively moving a second forming punch from the first flat forming portion to a second forming die with the second flat forming portion formed therein, through a bent forming portion having a radius R2, to thereby bend the first formed member by the bent forming portion of the second forming die;

the second forming step further comprising a substep for placing the second flat portion of the first formed member on the second flat portion side of the second forming die, so that the bent portion of the first formed member receives the bending-back force while abutting with at least one of the bent forming portion and the second flat forming portion, both of the second forming die.

In the second aspect, it is preferable that in the second forming step, a part of the bent portion of the first formed member abuts with a bend stop point on a second flat forming portion side of the bent portion of the second forming die.

Further, it is preferable that the method performs the second forming step using following formulas (A) and (B) in which k is obtained from the formula (A), and then ΔW is obtained from the formula (B) by the thus obtained k, $$k=-0.4836\cdot\ln(R2/R1)+0.1817 \quad (A)$$

$$\Delta W=(\pi/2-1)R2+(1-(1-k)\cdot\pi/2)R1 \quad (B)$$

wherein the formulas assume the first formed member to be formed along the first flat forming portion of the first forming die, the bent forming portion, and the second flat forming portion;

a symbol ΔW denotes a distance between the second flat portion of the first formed member and the second flat forming portion of the second forming die; and a symbol k denotes a proportion of the bent portion of the first formed member abutting to the second flat forming portion of the second forming die, to the total length of the bent portion.

Furthermore, it is preferable that the R1 is set to R1≦1.5R2 when the R2 is 5 mm or more, and to R1>1.5R1 when the R2 is less than 5 mm.

In the double bending method according to the present invention, the bent portion of the metal plate formed after the first forming step receives the bending-back force during the second forming method, and a bending moment in a direction opposite to the bending moment generating to the bent portion formed in the second forming step, thereby enabling to reduce the angle change defect of the bent portion formed in the second forming step. According to the method of bending of the present invention, forming can be performed by using a press or forming die with ease, thereby having superior productivity.

Third aspect resides in a method for bending a metal plate, comprising:

a step of preparing a forming die and a forming punch, said forming die having a forming surface in which a horizontal flat forming portion and an inclined flat forming portion being coupled with each other through a bent forming portion, said forming punch being used for bending a metal plate having an inclined flat forming portion parallel to the inclined flat forming portion of the forming die while collaborating with the inclined flat forming portion of the forming die; and a step of bending the metal plate held at the horizontal flat forming portion of the forming die, by using the bent forming portion and the inclined flat forming portion, in such a way that the inclined flat forming portion of the forming punch relatively moves closely or away to/from the inclined flat forming portion of the forming die;

wherein in this bending step, an angle formed between the horizontal flat forming portion of the forming die and the inclined flat forming portion is to be obtuse so that the bent arch portion of the metal plate, bent round the bent forming portion of the forming die, abuts simultaneously with both the inclined flat forming portion of the forming punch and the inclined flat portion of the forming die.

In the above-described method, the method uses the forming die that has predetermined θp and rp so as to have Δθp within an acceptable range, Δθp being obtained as a function Δθp of θp, rp, H, TS, t in advance, where TS denotes tensile strength of a metal plate; t, a thickness of the metal plate; rp, radius of a bent forming portion of the forming die; θp, an angle formed between the horizontal flat forming portion of the forming die and the inclined flat forming portion; Δθp, a difference between the θp and an angle formed between the horizontal flat forming portion and an inclined flat portion of the formed member after bending; and H, a vertical distance from the horizontal flat portion to the lower end thereof.

The function of Δθp, a formula (1) given below may be used, and said θp is preferably set to be 110° or more, and the H is preferably set to be 30 mm or more.

The method uses, as a function of Δθp, a formula (1) given below:

$$\Delta\theta p=TS/t\{c-1\cdot H^{(b1\cdot TS/t+b2)}\cdot(\theta p-90)^{n}\}\times\{1+\exp(d\cdot rp)\}\cdot(rp+0.5t)/\{f\cdot(5+0.5t)\} \quad (1)$$

where a, b1, b2, c, d, f, n are constant values.

Furthermore, in the above-described method, when bending with a forming die and a forming punch, the forming die having a flange forming portion formed parallel to the horizontal flat forming portion on the other end of the inclined flat forming portion of the forming die, and the forming punch having a flange forming portion formed parallel to the flange portion of the forming die on one end of the inclined flat forming portion of the forming punch, the method uses the forming die that has predetermined θp and H so as to have ΔW within an acceptable range, ΔW being obtained as a function ΔW of θp, H, Lf, TS, t in advance, where TS denotes tensile strength of a metal plate; t, a thickness of the metal plate; θp, an angle formed between the horizontal flat forming portion of the forming die and the inclined flat forming portion; H, a vertical distance between the flange forming portion and the horizontal flat forming portion of the forming die; and Lf, a length of a flange portion.

It is preferable that said θp is set to be 110° or more, and H is set to be 40 mm or more.

A formula (2) given below is used as a function of $$\Delta W=a\cdot(TS/t)\cdot H^{2}-b\cdot(\theta p-90)^{n0}\cdot H^{(n1\cdot TS/t+n2)}+(c\cdot H+d)\cdot Lf \quad (2)$$

where a, b, c, d, n0, n1, n2 are constant values.

According to a method of bending a metal plate of the invention, during the bending process, a metal is bent in an arch shape round a bent forming portion of a forming die, and the arch portion abutting with an inclined flat forming portion of the forming die and an inclined flat forming portion of the forming punch simultaneously for a certain period of time is crushed in the final phase of forming, whereby a moment opposite to a bending moment causing an angle change defect or curvature to the formed member is generated, thereby enabling to suppress defects on shapes. Moreover, forming can be performed by using a press or forming metal die with ease, thereby having superior productivity.

Other and further objects, features and advantages of the invention will appear more fully from the following description.

DETAILED DESCRIPTION OF THE PREFERRED EMBODIMENTS

Figure 1A:
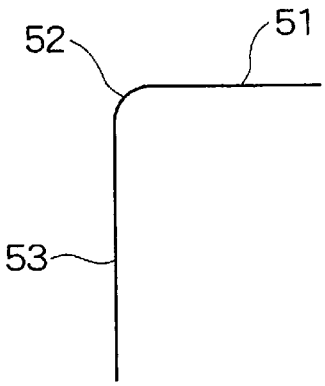
FIG. 1 is a cross sectional view of each formed member having a bent portion viewed from the side.
Figure 1B:
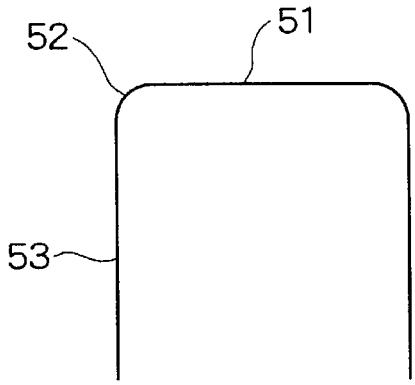
Figure 1C:
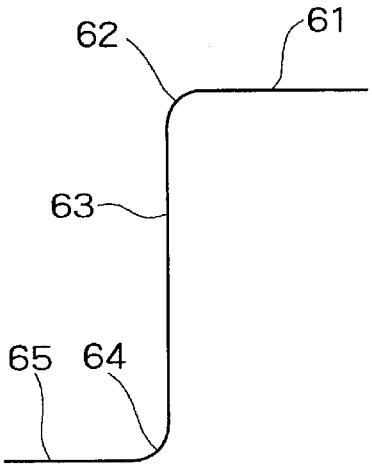
Figure 1D:
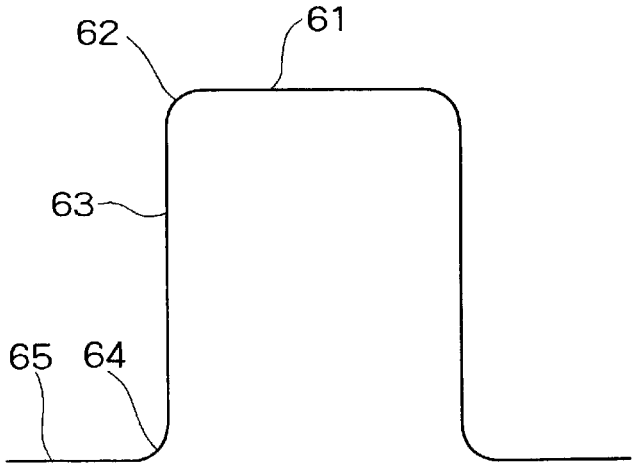

Formed members to which the present invention is applicable include a U-shaped member, a hat-channel shaped member, an L-shaped member, and a Z-shaped member formed by dividing the aforementioned members in two along symmetry axis, all of which has a bent portion formed by bending. Hereinbelow, the present invention will be described in detail with reference to the L-shaped member (FIG. 1A), that is the most basic shape of all members stated above.

The forming method according to the present invention (sometimes referred to as a double bending method) basically includes steps of: obtaining a first formed member having a bent portion by bending a metal plate at a first forming step; bending the bent portion of the first formed member the same direction as that at the first forming step; and bending back at a second forming step of it. By bending back the bent portion of the first formed member, a moment is generated in an opposite direction to a bending moment that generates an angle change of the bent portion of the second formed member obtained by the second forming step, thereby suppressing the angle change of the bent portion of the second member.

Figure 3A:
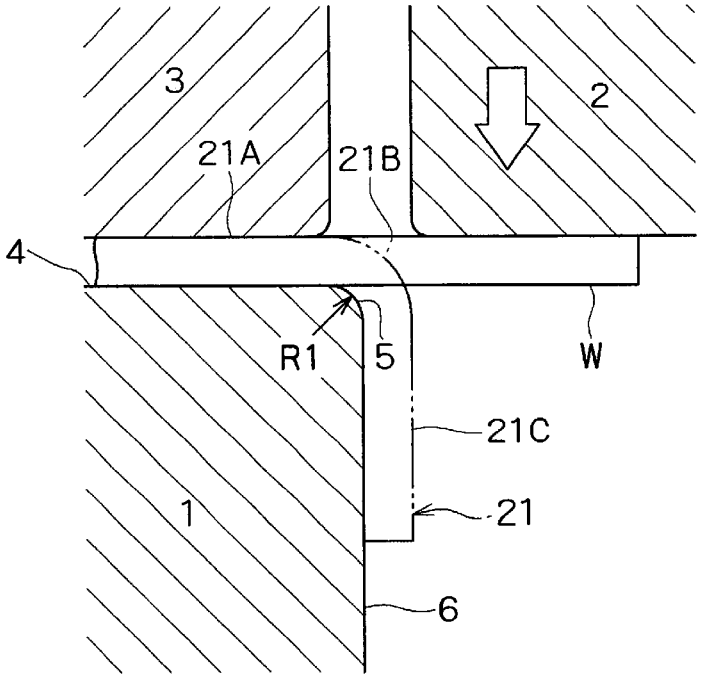
FIG. 3A is a cross sectional view illustrating positions of a forming die and a metal plate during a first forming step of a double bending method according to the present invention.
Figure 3B:
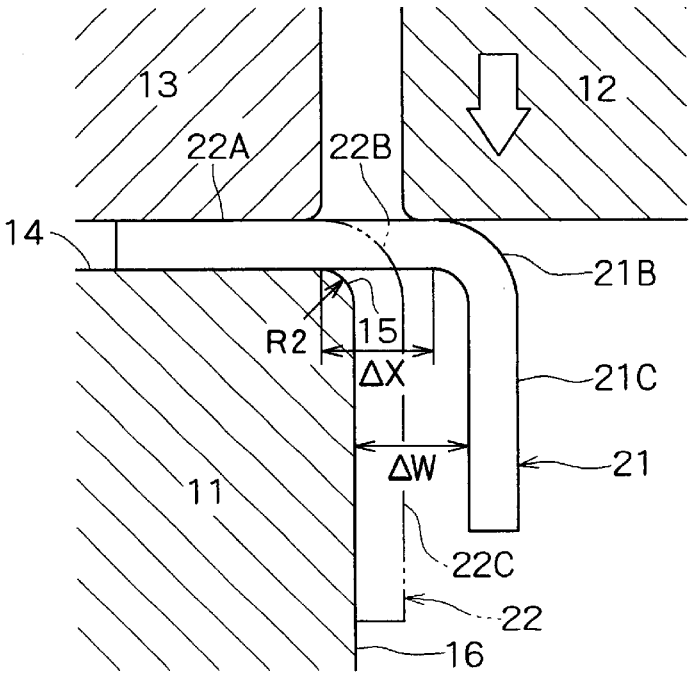
FIG. 3B is a cross sectional view illustrating positions of a forming die and a metal plate at a beginning of a second forming step of a double bending method according to the present invention.

FIG. 3 shows a forming die used for a method for bending a metal plate according to the present invention, in which FIG. 3A shows a first forming die used for the first forming step, and FIG. 3B shows a state that forming by using a second forming die used for the second forming step is about to begin. The first and second forming die respectively include first and second forming dies 1 and 11, first and second forming punches 2 and 12, first and second pads 3 and 13 for holding by pressing a metal plate W between upper flat forming portions 4 and 14 forming upper surfaces of the first and second forming dies 1 and 11.

The first and second forming dies 1 and 11 have longitudinal flat forming portions 6 and 16 formed thereto perpendicularly to the upper flat forming portions 4 and 14, through bent forming portions 5 and 15, from the upper flat forming portions 4 and 14, the bent forming portions 5 and 15 respectively having radius R1 and R2. The first and second forming dies can be commonly used except the first and second forming dies 1 and 11. The upper flat forming portions 4 and 14 of the forming dies 1 and 11 are compatible to the first flat forming portion of the present invention, and the longitudinal flat forming portion 6 and 16 are compatible to the second flat forming portion.

As shown in FIG. 3A, in the first forming step according to the present invention, one end of the metal plate W is depressed so as to be supported between the upper flat forming portion 4 of the first forming die 1 and the first pad 3, and the forming punch 2 is lowered to the forming die 1 side so as to bend the other end of the metal plate W at the bent forming portion 5 of the first forming die 1. Thereby, an upper flat portion 21A placed and held on the upper flat forming portion 4 of the first forming die 1, a bent portion 21B formed by the bent forming portion 5, and a longitudinal flat portion 21C formed by the longitudinal flat forming portion 6 are coupled so as to form the first formed member 21 having almost an L-shape.

Next, in the second forming step, as shown in FIG. 3B, assuming that the first formed member 21 is formed along the upper flat forming portion 4, the bent forming portion 5, and the longitudinal flat forming portion 6 of the first forming die 1 (i.e., assuming that there is no springback) while ΔW denoting a distance between an inner surface of the longitudinal flat portion 21C and the longitudinal flat forming portion 16 of the second forming die 11, the end portion of the upper flat portion 21A of the first formed member 21 bent and formed at the first forming step is placed on the upper flat forming portion 14 of the second forming die 11 so as to obtain $\Delta W \geqq 0$, and the end portion is pressed to be held at the second pad 13, and the second forming punch 12 is lowered so as to bend the member. Thereby, an upper flat portion 22A placed and held at the upper flat forming portion 14 of the second forming die 11, a bent portion 22B formed by the bent forming portion 15, and a longitudinal flat portion 22C formed by the longitudinal flat forming portion 16 are coupled so as to obtain the second formed member 22.

The second forming step adopts $\Delta W \geqq 0$, and therefore, the bent portion 21B of the first formed member 21 is bent and formed so as to abut against the bent forming portion 15 of the second forming die 11 or the longitudinal flat forming portion 16, or both thereof. The bent portion 21B of the first formed member 21 receives bending-back force at that time. In FIG. 3B, ΔX denotes a distance between a bend stop point on a side of the upper flat portion of the bent portion 21B of the first formed member 21 and that of the upper flat portion of the bent portion 22B of the second formed member 22 before and after the second forming step.

Figure 4:
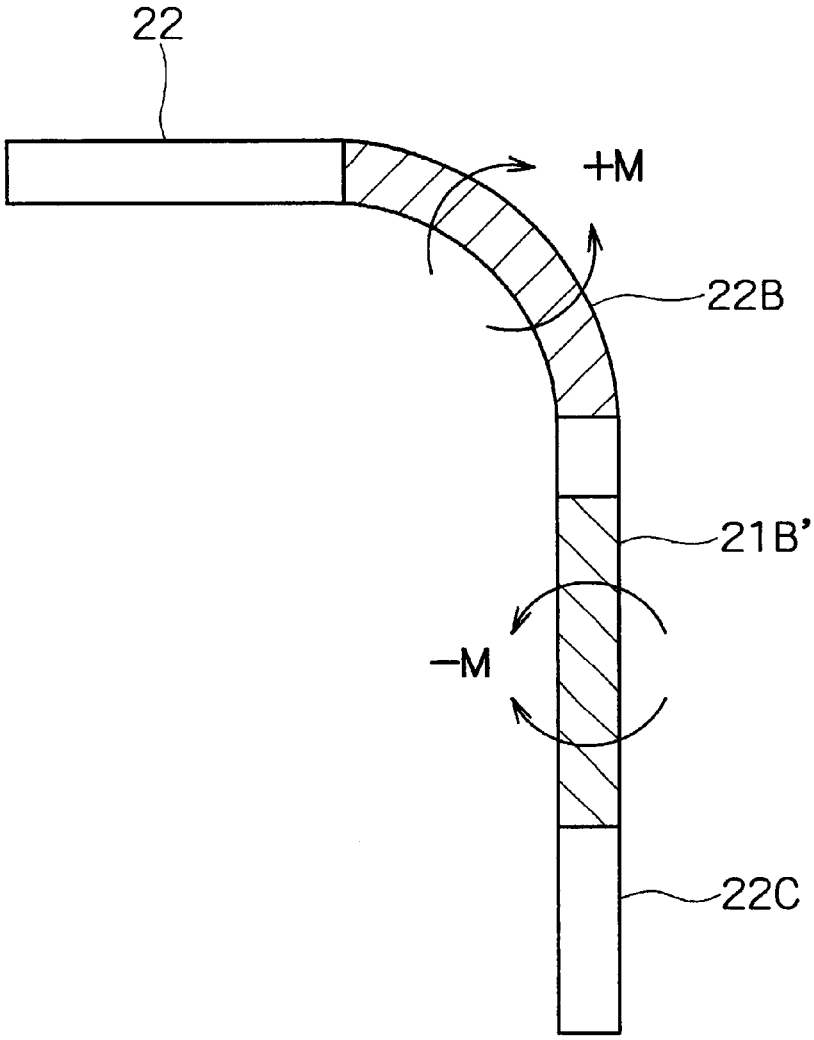
FIG. 4 is a cross sectional view showing a state where a bending moment of the formed member is generated after the second forming step.

According to the above-described double bending method, the bent portion 21B of the first formed member 21 receives springback force during the second forming step. Therefore, although elastic recovery moment (+M) causing an angle change defect Δθ is generated at the bent portion 22B of the second formed member 22 as shown in FIG. 4, a moment (−M) canceling out the above-described Δθ is generated at a part 21B' of the longitudinal flat portion 22C of the second formed member 22 corresponding to the bent portion 21B of the first formed member 21. Therefore, Δθ can be reduced after the member is removed from the die.

In order to check the effect of the double bending method, an L-shaped member is formed under the condition of R1, R2 and $\Delta W(\geqq 0)$ shown in table 1 by using a steel plate having thickness of 1.0 mm and tensile strength of 460 Mpa so as to measure an angle change defect Δθ2 of a bent portion of the second formed member after forming is completed. For comparison, by using the forming die used for the second forming step (the bent forming portion has a radius of R2), a member is formed by a single bending, and an angle change defect Δθ1 of the bent portion after removed from the die is measured. In addition, a reduction rate of the angle change defect A is calculated by a formula below. Results of measurement and calculation are also shown in the table 1.

$$A(\%)=(\Delta\theta 1-\Delta\theta 2)/\Delta\theta 1\times 100$$

TABLE 1

| Sample No. | R1 (mm) | R2 (mm) | ΔW (mm) | Δθ1 (°) | Δθ2 (°) | A (%) | R2/R1 in minimum Δθ2 | k in minimum Δθ2 |
|---|---|---|---|---|---|---|---|---|
| 1 | 10 | 3 | 7 | 4.8 | 1.2 | 75.0 | 0.3 | 1.7 |
| 2 | 10 | 3 | 9 | 4.8 | 2.0 | 58.3 | — | — |
| 3 | 5 | 3 | 2 | 4.8 | 0.8 | 83.3 | 0.6 | 0.4 |
| 4 | 5 | 3 | 3 | 4.8 | 1.5 | 68.8 | — | — |
| 5 | 5 | 3 | 4 | 4.8 | 2.2 | 54.2 | — | — |
| 6 | 5 | 3 | 5 | 4.8 | 2.8 | 41.7 | — | — |
| 7 | 3 | 3 | 0 | 4.8 | 3.5 | 27.1 | — | — |
| 8 | 3 | 3 | 1 | 4.8 | −0.5 | 110.4 | 1.0 | 0.212 |
| 9 | 3 | 3 | 2 | 4.8 | 1.2 | 75.0 | — | — |
| 10 | 3 | 3 | 3 | 4.8 | 3.8 | 20.8 | — | — |
| 11 | 3 | 3 | 4 | 4.8 | 4.7 | 2.1 | — | — |
| 21 | 10 | 5 | 6 | 6.5 | 2.0 | 69.2 | 0.5 | 0.564 |
| 22 | 10 | 5 | 7 | 6.5 | 2.0 | 69.2 | — | — |
| 23 | 10 | 5 | 9 | 6.5 | 3.0 | 53.8 | — | — |
| 24 | 5 | 5 | 0 | 6.5 | 5.2 | 20.0 | — | — |
| 25 | 5 | 5 | 2 | 6.5 | 1.0 | 84.6 | 1 | 0.255 |
| 26 | 5 | 5 | 3 | 6.5 | 2.0 | 69.2 | — | — |
| 27 | 5 | 5 | 4 | 6.5 | 2.5 | 61.5 | — | — |
| 28 | 5 | 5 | 5 | 6.5 | 4.5 | 30.8 | — | — |
| 29 | 3 | 5 | 0 | 6.5 | 0.2 | 96.9 | 1.7 | 0.24 |
| 30 | 3 | 5 | 1 | 6.5 | 0.5 | 92.3 | — | — |
| 31 | 3 | 5 | 2 | 6.5 | 2.5 | 61.5 | — | — |
| 32 | 3 | 5 | 3 | 6.5 | 4.7 | 27.7 | — | — |
| 33 | 3 | 5 | 4 | 6.5 | 5.7 | 12.3 | — | — |

TABLE 1-continued

| Sample No. | R1 (mm) | R2 (mm) | ΔW (mm) | Δθ1 (°) | Δθ2 (°) | A (%) | R2/R1 in minimum Δθ2 | k in minimum Δθ2 |
|---|---|---|---|---|---|---|---|---|
| 41 | 10 | 10 | 0 | 7.7 | 7.0 | 9.1 | — | — |
| 42 | 10 | 10 | 4 | 7,7 | 3.0 | 61.0 | 1 | 0.255 |
| 43 | 10 | 10 | 6 | 7.7 | 3.5 | 54.5 | — | — |
| 44 | 10 | 10 | 7 | 7.7 | 4.2 | 45.5 | — | — |
| 45 | 10 | 10 | 9 | 7.7 | 4.2 | 45.5 | — | — |
| 46 | 5 | 10 | 0 | 7.7 | 5.0 | 35.1 | — | — |
| 47 | 5 | 10 | 2 | 7.7 | −0.3 | 103.9 | 2 | −0.11 |
| 48 | 5 | 10 | 3 | 7.7 | 2.2 | 71.4 | — | — |
| 49 | 5 | 10 | 4 | 7.7 | 2.5 | 67.5 | — | |
| 50 | 5 | 10 | 5 | 7.7 | 3.0 | 61.0 | — | — |

According to the table 1, by performing the double bending method, the reduction rate of the angle change defect A becomes A>0% for every forming condition, thereby it is confirmed that the double bending method can suppress the angle change defect. Also, it is acknowledged that a condition A≧100%, i.e., Δθ2>0° exists.

Next, based on a result obtained by examining the conditions of R1, R2 and ΔW so that Δθ2 become as close to 0° as possible, setting of the optimum condition will be described below.

Figure 5:
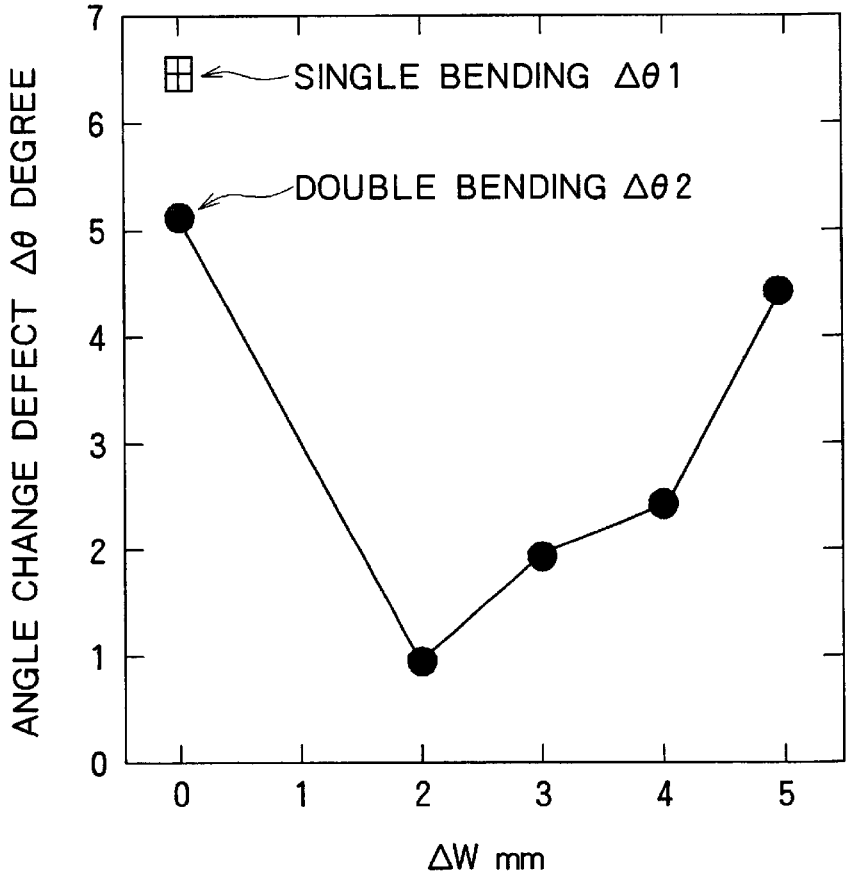
FIG. 5 is a graph showing relationships the angle change defect Δθ at bent portions the second formed member and a shifting distance ΔW of the first formed member with respect to a second forming die.

FIG. 5 shows results showing relationships of Δθ1, Δθ2, and ΔW of samples Nos. 24 to 28 of the table 1 when R1=R2=5 mm while varying ΔW. According to the graph, it is found that Δθ2 becomes its minimum value with a certain optimum ΔW.

Figure 6:
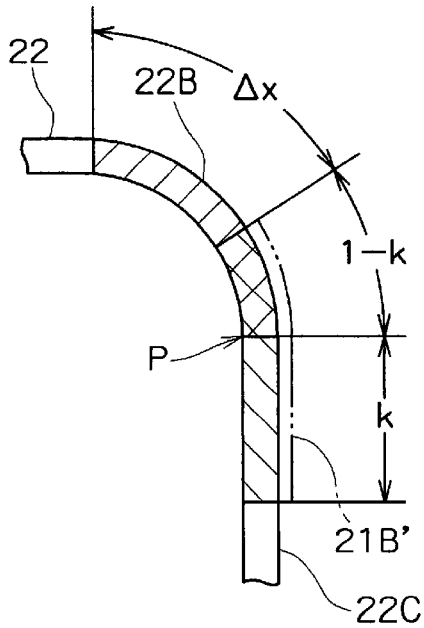
FIG. 6 is a cross sectional view illustrating a corresponding relationship of the bent portion of the first formed member to the second formed member.

Accordingly, the optimum ΔW was examined. FIG. 6 shows a forming state during the second forming step. As shown in FIG. 6, when a part of the bent portion 21B of the first formed member 21 exists at a bend stop point P on a side of the longitudinal flat portion of the bent portion 22B of the second formed member 22, Δθ2 tends to be the minimum value.

The above finding will be described in detail below. As shown in FIG. 6, when a total length of a portion 21B' corresponding to the bent portion 21B of the first formed member 21 in the second formed member 22 is represented as 1, and a proportion of an area where the corresponding portion 21B' covers over the longitudinal flat forming portion 16 of the second forming die 11, that is, a proportion of the bent portion 21B of the first formed member 21 corresponding to the longitudinal flat portion 22C of the second formed member 22 from the P is represented as k, then ΔX (see FIG. 3B) is expressed by a formula (1) below. As shown in FIG. 3B, ΔW is expressed by a formula (2) below, and a formula (3) is obtained by substituting ΔX of the formula (1) for the formula (2):

$$\Delta X=\pi/2\cdot R2-(1-k)\cdot\pi/2R1 \quad (1)$$

$$\Delta W=\Delta X-R2+R1 \quad (2)$$

$$\Delta W=(\pi/2-1)R2+(1-(1-k)\cdot\pi/2)R1 \quad (3).$$

In a case of FIG. 5, Δθ2 is minimum when ΔW=2 mm. Therefore, from the formula (3), ΔW=2 is substituted to obtain k, whereby k=0.255 is obtained. This means that the bent portion of the first formed member is formed so as to cover about ¾ over the bending forming portion of the second forming die.

Figure 7A:
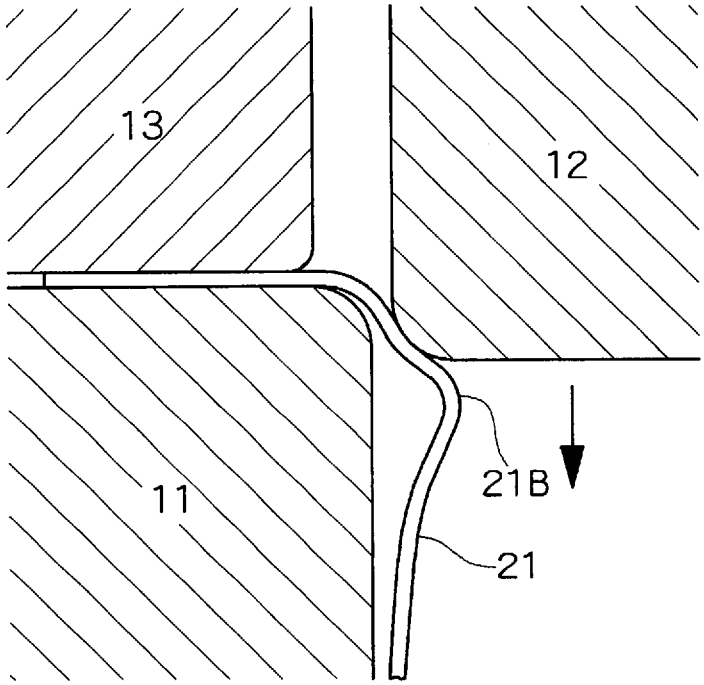
FIG. 7A is a cross sectional view illustrating behavior of changes that metal plate takes during the double bending method when ΔW is large.
Figure 7B:
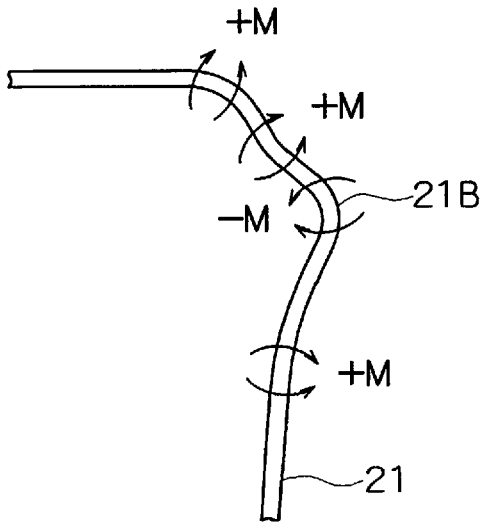
FIG. 7B is a cross sectional view illustrating a state when a bending moment is generated around the bent portion of the metal plate.

Hereinbelow, the reason that Δθ2 increases as ΔW increases after Δθ2 took the minimum value will be described. When ΔW takes a large value, an area including the bent portion 21B of the first formed member 21 becomes wider outward from the bent forming portion 15 of the second forming die 11 during the first stage of the second forming. The area that goes wide is crashed by a corner of the second forming punch 12 as shown in FIG. 7A. A moment generated to the area, as shown in FIG. 7B, reduces a moment (−M) canceling out the angle change defect due to a moment (+M) that increases the angle change defect generating at various portions. Accordingly, when ΔW increases, Δθ2 also increase.

Next, the optimum R1 and ΔW(k) values enabling to suppress Δθ2 as small as possible will be described according to a case where the radius R2 of the bent forming portion 15 of the second forming die 11 determining the radius of the bent portion of the product is already given.

In order to solve the problem, the inventor examine values for R2/R1 and k that minimize Δθ2 when bending the member with various combination of values for R1 and R2, based on data on the table 1. The examined result is also shown in FIG. 1. Note that bent portions of samples formed by the double bending method to minimize the value of Δθ2 is formed by bending generally along R2 of the second forming die.

Figure 8:
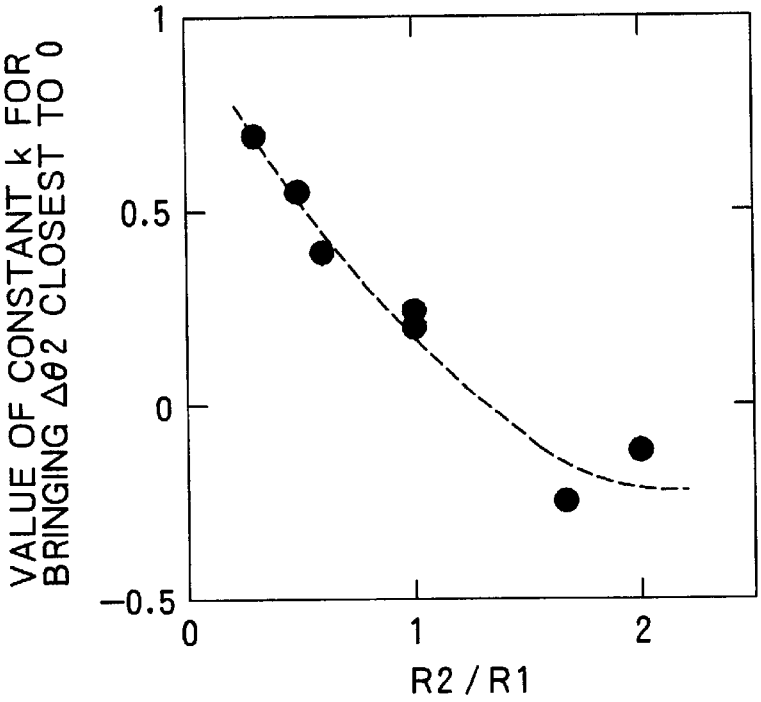
FIG. 8 is a graph illustrating relationships of R2/R1 with a constant k for bringing the angle change defect Δθ2 at the bent portion of the second formed member as close to 0.

Based on the aforementioned data, a graph shown in FIG. 8 is formed to illustrate a relationship between R2/R1 and a constant k for obtaining the minimum value for Δθ2, i.e., a value that makes Δθ2 as close to 0° as possible. As shown in FIG. 8, the constant value k for making Δθ2 as close to 0° as possible shows a strong correlation with R2/R1. Therefore, when R2/R1 is small, the problem can be solved by setting a value fork larger, and likewise, when R2/R1 is large, the value of k is smaller. From the data in FIG. 8, an approximate formula (4) shown below is obtained, and with the formula (4), it is possible to obtain the optimum k value for R2/R1:

$$k=-0.4836\cdot\ln(R2/R1)+0.1817 \quad (4).$$

Figure 9:
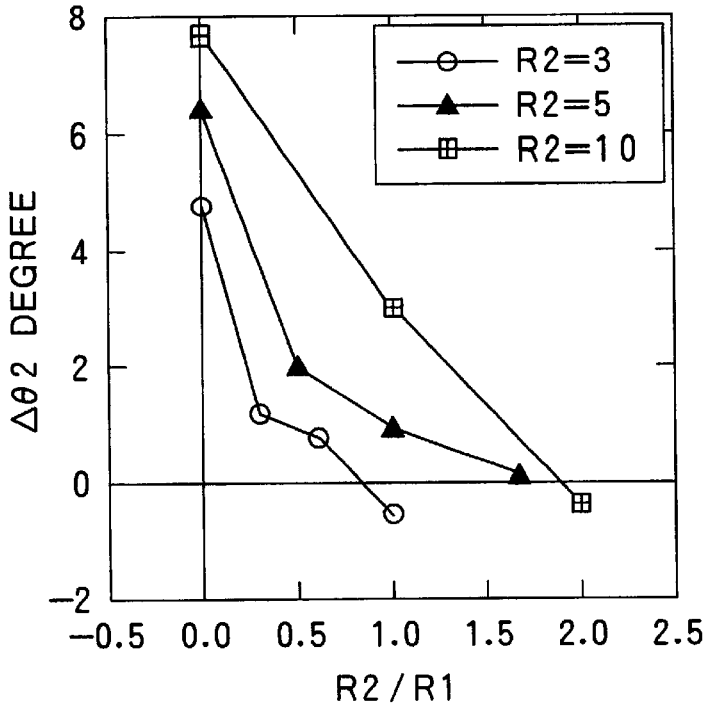
FIG. 9 is a graph relationships of R2/R1 with Δθ2 for each case when the radius R2 of the bending forming portion of the second forming die is 3 mm, 5 mm and 10 mm.

Moreover, hereinbelow, R1 for bringing Δθ2 closest to 0° in a case where the radius (target radius=R2) of the bent portion of the product (the second formed member) is the same, will be described. FIG. 9 is a graph illustrating relationships of R2/R1 and Δθ2 for every R2 obtained from sample data for acquiring R2/R1 and k for taking the minimum value for Δθ2. In FIG. 9, a value for Δθ1 for a single bending forming is shown as Δθ2 when R2/R1=1 (R1=∞). According to FIG. 9, when the angle change defect Δθ1 after single bending is large while R2 is large, R2/R1 needs to have large value. On the other hand, when the angle change defect Δθ1 after single bending is small while R2 is small, R2/R1 can be a small value. For example, when R2≧5 mm, by setting R2/R1 to 1.5 or more, Δθ2 can be almost 1° or less. Moreover, if R2<5 mm, by setting R2/R1 to less than 1.5, or preferably 0.25<R2/R1<1.5, Δθ2 becomes almost 1° or less.

The above example is based on the double bending method for a steel plate of 1.0 mm thickness with 440 Mpa class tensile strength. The combination of values for R1 (mm), R2 (mm) and ΔW (mm) for achieving Δθ2≈0° are as follows:

$$(R2, R1, \Delta W)=(3,3,1), (5,3,1), (10,5,2).$$

Figure 10:
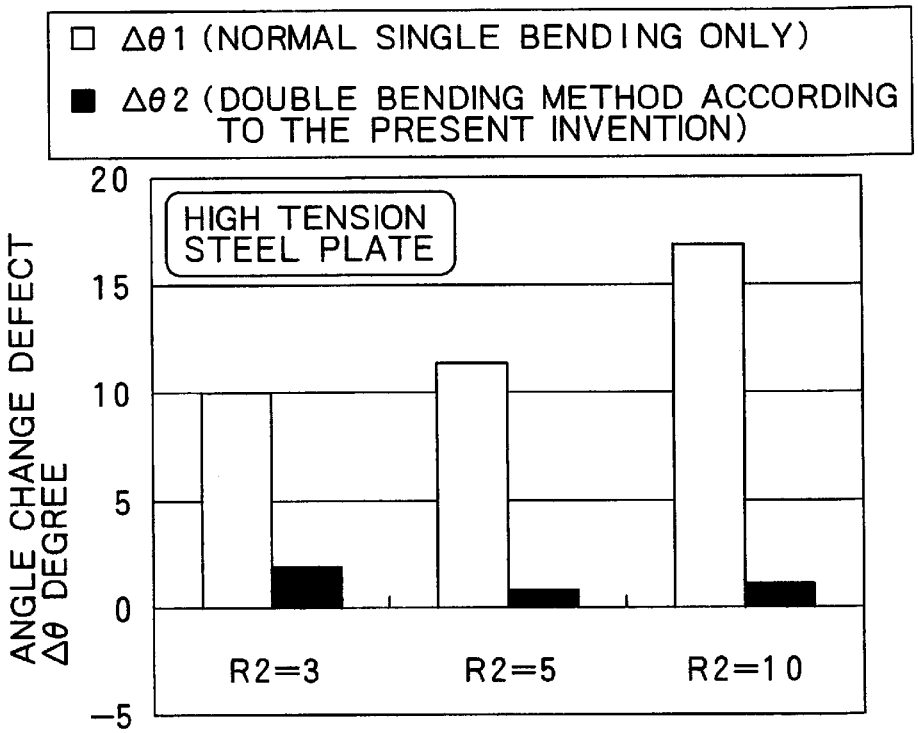
FIG. 10 is a graph comparing the angle change defect Δθ of the conventional single bending forming and the double bending method for the high tension steel plate for cases where R2 are set to 3, 5, and 10 mm.

By using the values provided above, the high tension steel plate (tensile strength 1008 MPa and a thickness 1.2 mm) and 5000 type aluminum based alloy plate (tensile strength 281 MPa and a thickness 1.0 mm) are bent according to the double bending method, and Δθ2 was measured. For comparison, a member is formed by a single bending method by using the second forming die having a bent forming portion with radius R2, and the angle change defect Δθ1 of the bent portion after removed from the die was measured. Comparison of those measurement results are shown in FIG. 10 for the high-tension steel plate, and FIG. 11 for the aluminum based alloy plate. From these figures, it is confirmed that the double bending method according to the present invention is effective in terms of reducing the angle change defect of the bent portion without having any bearing on the strength of the material or a type of the material.

The present invention can be applied not only to the L-shape and Z-shaped members as described above, but to a U-shaped member and a hat-channel shaped member formed by placing the L-shape or Z-shaped members in a symmetrical fashion. In cases of the U-shape and hat-channel shaped members having a symmetrical figure, longitudinal flat portions of right and left sides are formed simultaneously by pressing. Since deformation of the upper flat portion is inherently small, pads for pressing and holding the metal plate does not need to be used. A pressing device used for the present invention is not limited to anything specific, and may be used for an oil hydraulic press, a mechanical press, an opposed hydraulic press and the like.

The double bending method according to the present invention does not require to perform the first and second forming steps separately, and both steps can be performed by forming portions through a single action made by one movement of the forming punch. Hereinbelow, with reference to an example, a forming die (R1=R2=R) and its operation will be described for a case of performing the double bending method according to the present invention by a single action.

As shown in FIG. 12, the forming die for performing the present invention by the single action forming includes: a forming die 31 having a longitudinal flat forming portion formed through a bent forming portion from an upper flat forming surface; a pad 33 for holding by pressing a metal plate W between the upper flat forming portion of the forming die 31; a forming punch 32 for bending the metal plate W, from the bent forming portion, along the longitudinal flat forming portion; and a position determining member 35 for determining a position of the forming die 31 in a horizontal direction within a forming die case 34. The forming punch 32 has a first flat forming portion 32A and a second flat forming portion 32B provided in a step-wise manner from a bottom flat portion through a step portion 32C so as to be parallel to the forming die 31. The forming die 31 is biased on a backside of the forming die case 34 by an elastic member so as to freely move in a to-to-fro direction. On a back surface of the forming die 31, there is a first position determining surface portion 31A and a second position determining surface portion 31B provided in a step-wise manner. The position-determining member 35 is biased upward by the elastic member and housed in the forming die case 34 so as to freely move vertically therewithin. Moreover, the position determining member 35 has an abutting surface 36 for determining a horizontal position of either the first position determining surface portion 31A or the second position determining surface portion 31B of the forming die 31 while abutting therewith.

Figure 12A:
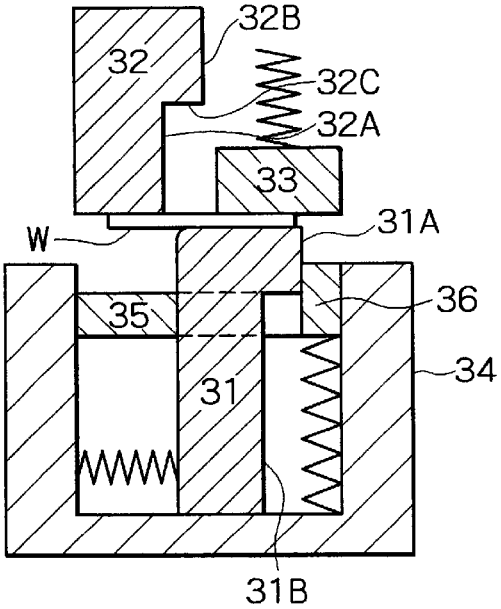
FIG. 12 is a cross sectional view illustrating the forming die for performing the double bending method by a single action of the forming punch and movements thereof.
Figure 12B:
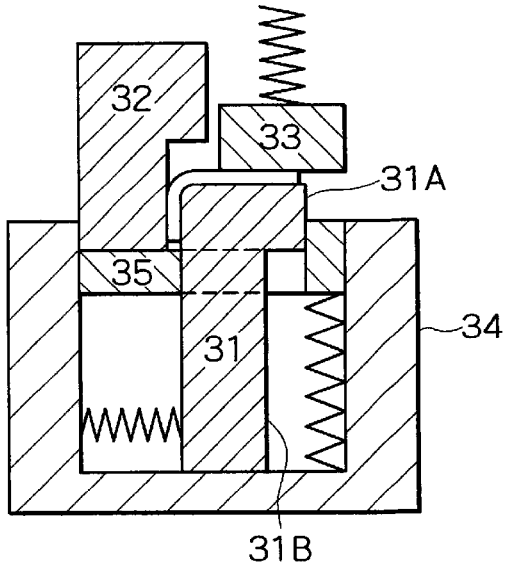
Figure 12C:
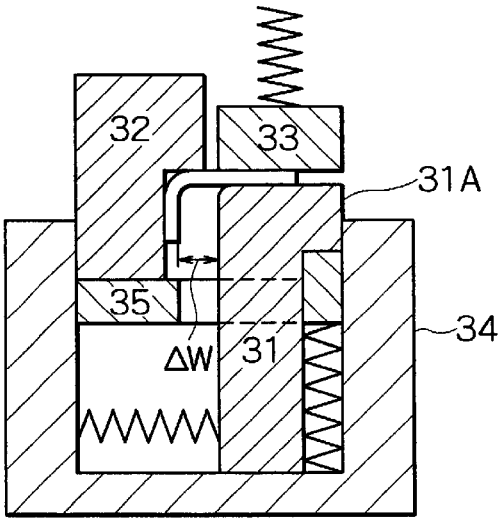
Figure 12D:
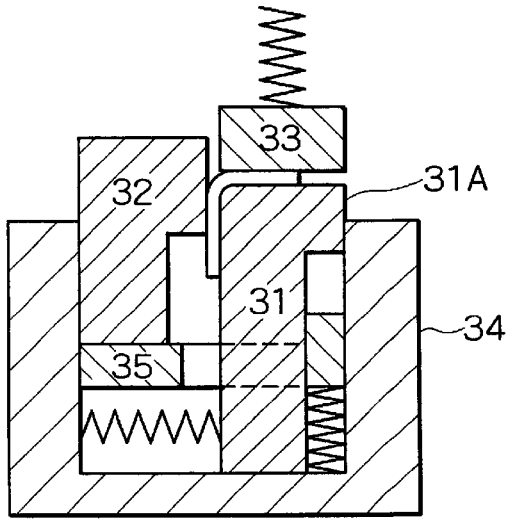

FIG. 12A shows a state where the forming begins. The forming punch 32 is lowered so as to bend the metal plate W by the bottom flat portion and the first flat forming portion 32A. As shown in FIG. 12B, after the bottom flat portion abuts with the position-determining member 35, the forming punch is lowered even further. As shown in FIG. 12C, when the abutting surface portion 36 of the position determining member 35 is detached from the first position determining surface portion 31A of the forming die 31 by lowering the forming punch 32, the forming die 31 moves backward by ΔW so as to determine a horizontal position by the second position determining surface portion 31B abutting with the abutting surface portion 36. The forming punch 32 continues to be lowered as shown in FIG. 12D, and at the second flat forming portion 32B, a first L-shaped member formed by bending once is formed by bending so that a bent portion of the first L-shape formed member receives bending-back force by the step portion 32C and the second flat forming portion 32B.

Next, another forming method according to the present invention will be described.

Figure 13A:
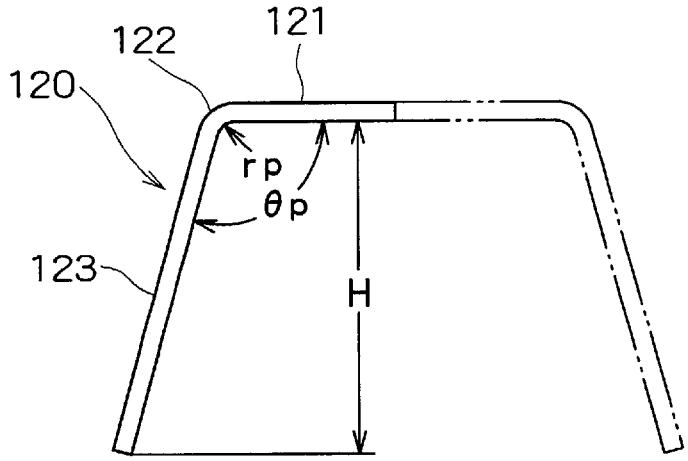
FIG. 13 is a cross sectional view of the U-shaped member and Z-shaped member according to the present invention viewed from the side.
Figure 13B:
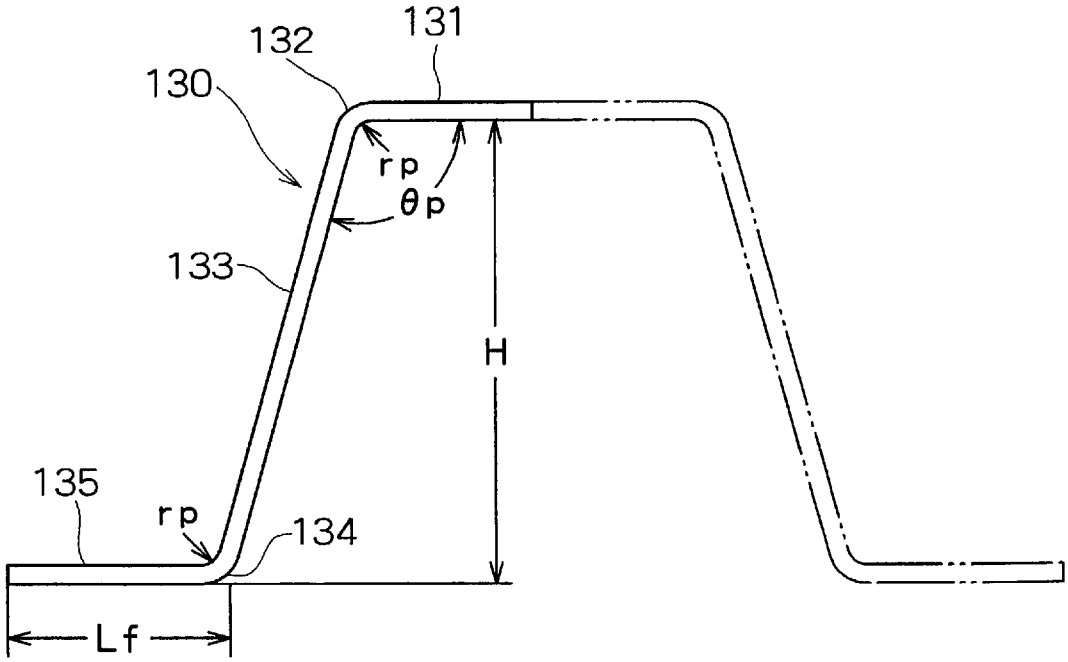

The present invention is applicable to the aforementioned U-shaped member, the hat-channel shaped member, and the L-shape and Z-shaped members that can be obtained by dividing the U-shape or the hat channel shape along the symmetrical line. Factors for defining a shape of a member formed according to the present invention will be described with reference to FIG. 13 by using the L-shaped member and Z-shaped member as examples. FIGS. 13A and 13B show the L-shaped member and Z-shaped member, respectively. The factors for determining the shape of the formed members include: an angle θp formed between upper flat portions 121 and 131, and inclined flat portions 123 and 133 (a bending angle); radius rp of the bent portion 122 and 132 formed between the upper flat portion 121 and 131 and the inclined flat portion 123 and 133; a distant H from the upper flat portion 121 and 131 to the lower end of the inclined flat portion 123 and 133 (a forming height); and, in case for the Z-shaped member, a length Lf of a flange portion 135 formed parallel to the upper flat portion 131, through the bent portion 134, with radius rd from the lower end of the inclined flat portion 133. The lower end of the inclined flat portion 133 of the Z-shaped member (as well as the hat-channel shaped member) refers to a intersection of extended lines from an inner surface of the inclined flat portion 133 and the lower surface of the flange portion 135.

Conventionally, influences of the shape factors of the product to the dimensional accuracy have been studied. However, majority of studies only examine influences of bent portions rd on a flange portion side and bent portions rp on the upper flat portion side when the angle θp between the upper flat portion and the inclined flat portion is 90°, and influences of the θp, the forming height H, and the flange length Lf toward the dimensional accuracy have not been considered.

Figure 2A:
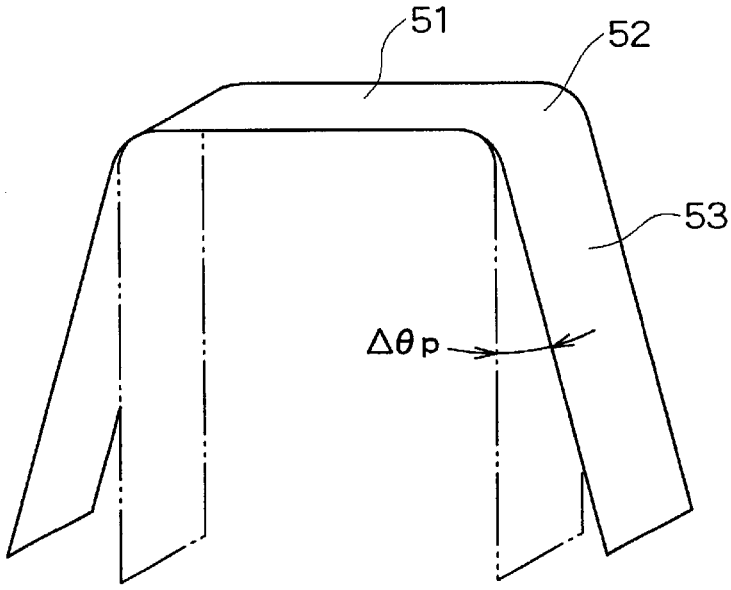
FIG. 2 is a diagram illustrating an angle change defect Δθ at bent portions of a U-shaped member and a hat channel shape member.
Figure 2B:
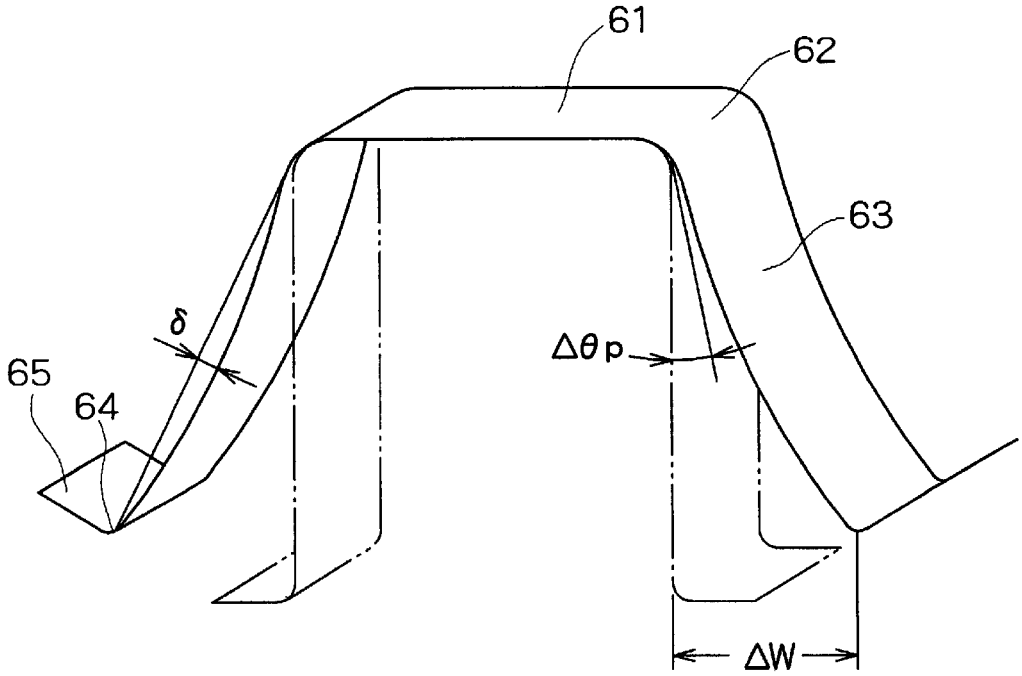

The present invention is achieved by examining other factors θp, H, and Lf than rp and rd irrespective of the case of θp=90°, to suppress the angle change defect Δθp or wall curvature δ (see FIG. 2) at bent portions 22 and 32 by determining those factors appropriately.

First, bending of the most basic shape of a member to which the present invention is applicable, an L-shaped member, will be described in detail.

Figure 14:
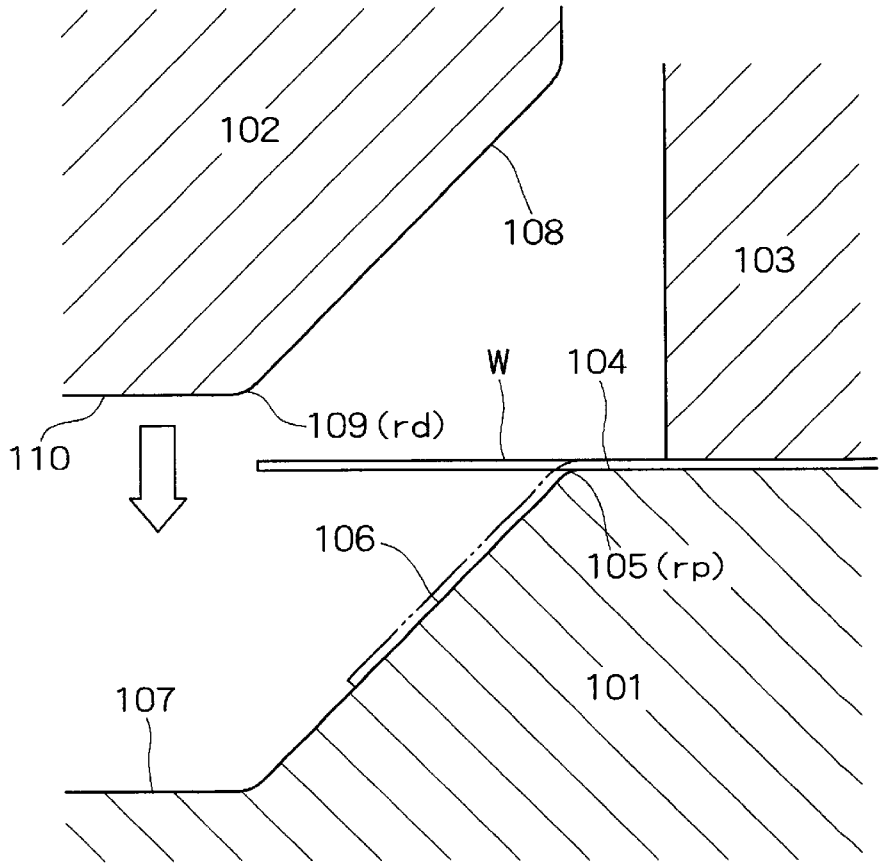
FIG. 14 is a cross sectional view illustrating the forming die used for the bending forming method of the present invention.

FIG. 14 shows a forming die for performing the forming method of the present invention, the forming die including a forming die 101, a forming punch 102, and a pad 103 for holding by pressing a metal plate W between an upper flat forming portion 104 for forming an upper surface of the forming die 101. The forming die 101 has an inclined flat forming portion 106 and a flange-forming portion 107 formed therewith. The inclined flat forming portion 106 is formed from the upper flat forming portion 104 through the bent forming portion 105 having radius rp toward the lower direction so as to form an angle θp with respect to the upper flat forming portion 104. The flange-forming portion 107 is formed on the other end of the inclined flat forming portion 106 so as to be parallel to the upper flat forming portion 104. In the present invention, in order to achieve a final phase of forming described later, the θp is set to be an obtuse angle (θp>90°). A distance between the upper flat forming portion 104 of the forming die 101 and the flange forming portion 107 is set to be equal or longer than the forming height H of the L-shaped member 120 so that the inclined flat portion 123 of the L-shaped member 120 is formed to the lower end of the member.

The forming punch 102 has an inclined flat forming portion 108 parallel to the inclined flat forming portion 106 of the forming die 101. A lower end of the inclined flat forming portion 108 has a flange-forming portion 110 parallel to the flange-forming portion 107 of the forming die 101, through a bent forming portion 109 with radius rd. The forming punch 102 is provided so as to freely move closely and away to/from the forming die 101 in a vertical direction.

The forming method according to the present invention is a method for forming a member so as to obtain a target shape of the formed member directly and as close as possible, from a shape of the forming portion of the forming die, and therefore, same reference symbols (θp, rp and the like) represent the forming factors of the forming portion of the forming die and shaping factors of the formed member. The flange forming portion 107 of the forming die 101, the bent forming portion 109 of the forming punch 102, and the flange-forming portion 110 are not used directly for forming the L-shape and U-shaped members, but used for forming the Z-shape and hat-channel shaped members described later. The upper flat forming portion 104 of the forming die 101 corresponds to a horizontal flat forming portion of the present invention.

According to the method of the present invention for bending a member, as shown in FIG. 14, one end of the metal plate W is pressed and held between the upper flat forming portion 104 of the forming die 101 and the pad 103, and by lowering the forming punch 102 toward the forming die 101, the other end of the metal plate W is bent along the bent forming portion 105 of the forming die 101 and the inclined flat forming portion 106, so as to obtain an L-shaped member 120 shown in FIG. 13A.

Figure 15:
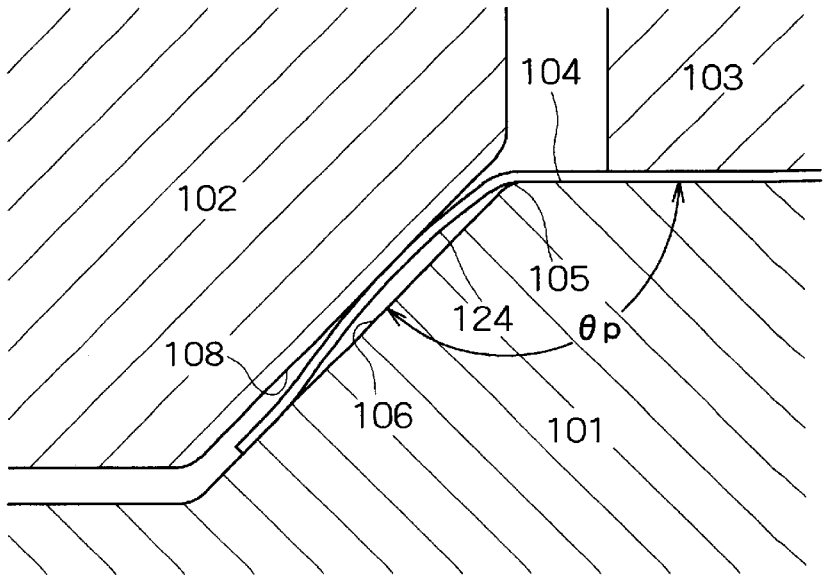
FIG. 15 is across sectional view illustrating a final phase of forming in forming the L-shaped member according to the present invention.
Figure 16:
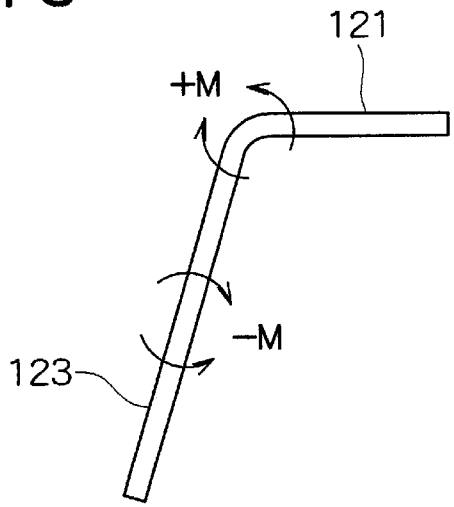
FIG. 16 is a cross sectional view illustrating a state where bending moment is generated immediately after the L-shaped member formed according to the present invention is removed from the die.

Important aspects for bending the members in the present embodiment come to the final phase of forming. FIG. 15 shows the final phase of forming. When the metal plate W is bent by lowering the forming punch 102 toward the forming die, the metal plate W is bent in an arch shape round the bent forming portion 105 of the forming die 101. The bent arch portion 124 comes to contact with the inclined flat forming portion 108 of the forming punch 102, the inclined flat forming portion 106 of the forming die 101 in that order as the forming punch 102 is lowered. A state where the arch portion is abutting with both inclined flat-forming portions 108 and 106 continues for a certain period of time. In the final phase of forming, the arch portion 124 is completely crushed by the inclined flat forming portion 108 of the forming punch 102 while being interposed between the inclined flat forming portion 108 of the forming punch 102 and the inclined flat forming portion 106 of the forming die 101. The crushed arch portion tends to spring back (recover elastically) to a shape having the curvature of the same direction to the arch portion 124 at the inclined flat forming portion 121 of the L-shaped member 120 after removed from the die. As shown in FIG. 16, before removed from the die, a bending moment −M in a direction of canceling out the bending moment +M for causing the angle change defect to the bent portion 122 of the L-shaped member 120, thereby the bent change defect θp of the bent portion 122 is suppressed. Therefore, by setting θp of the forming die 101 appropriately, it is possible to suppress the angle change defect Δθp (an angle formed between tangent at a bend stop point on the inclined flat portion side of the bent portion 122 and an inclined flat portion of the target forming shape) within an acceptable range.

Figure 17:
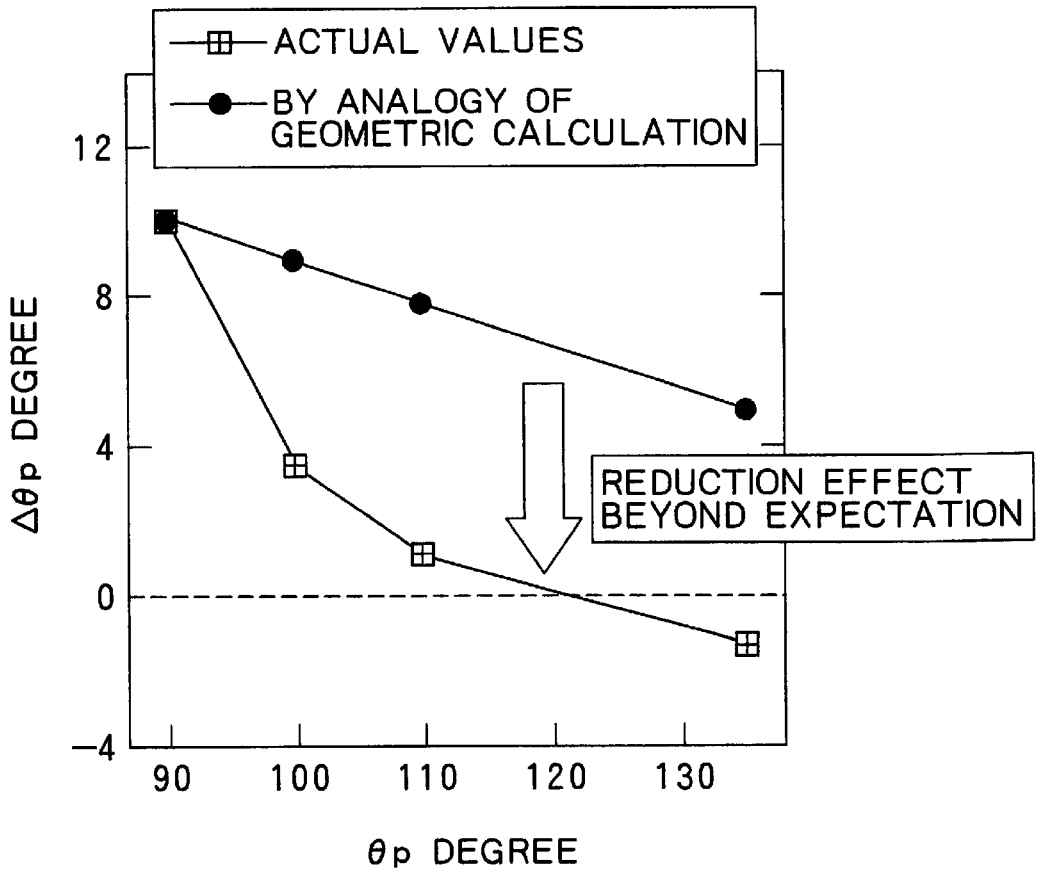
FIG. 17 is a graph showing relationships of θp and Δθp inferred from geometrical analogy from a winding angle of the bent forming portion of the forming die and that of actual values obtained from the actual forming.
Figure 18:
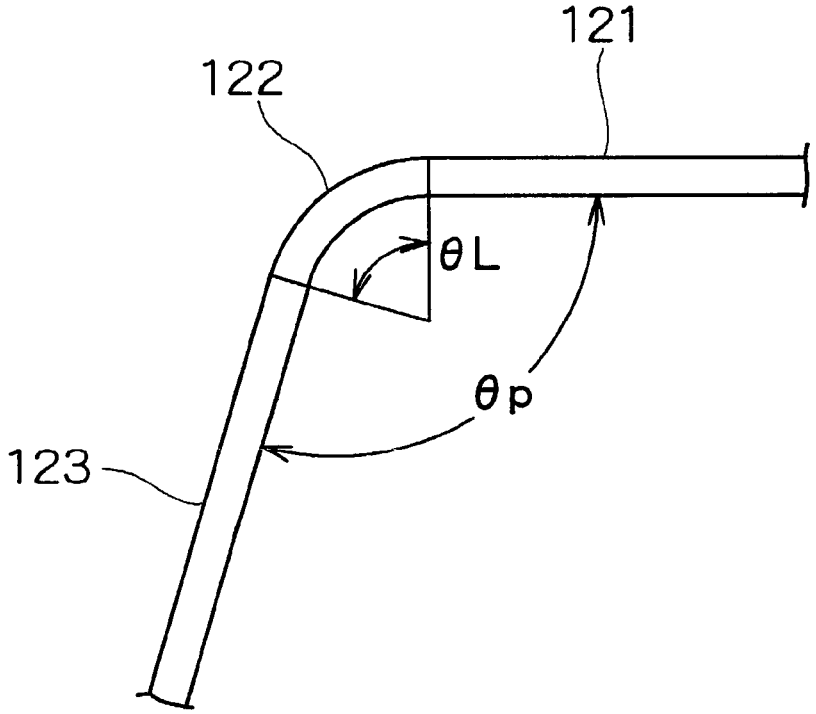
FIG. 18 is a cross sectional view illustrating a winding angle θL at the bent forming portion of the forming die.

An effect for suppressing the shape change by crushing the arch portion 124 is proved by the following study. FIG. 17 is a graph showing the relationship of θp and Δθp when an L-shaped member is formed with a steel having tensile strength of 1008 MPa, a thickness of 1.2 mm, and target forming height H of 55 mm, in which actual measured values and a predictive values predicted from a geometric relationships are both provided. As for the angle change defect, the larger the bending angle θp of the bent forming portion 105 of the forming die 101, as shown in FIG. 18, the smaller an opening angle θL (θL=180°−θp) of the bent forming portion 105 where the metal plate winds around. Therefore, Δθp predicted from the geometrical relationship can be calculated from the formula below, $$\Delta\theta p\ (\text{geometric})=\Delta\theta p90\times(180-\theta p)/90$$

where Δθp90 denotes an angle change defect at θp=90°.

As seen from FIG. 17, the actual values are far smaller than the predicted value from the geometric relationships, and there are even values of θp where Δθp become negative values. This is possible thanks to the effect of improving the angle change defect by the crush of the arch portion, and the effect clearly excels the reduction of the angle defect predicted merely from the geometric relationships.

Next, conditions for a size of the forming die (a target shape of a formed member) that suppresses Δθp as much as possible will be described.

Figure 19:
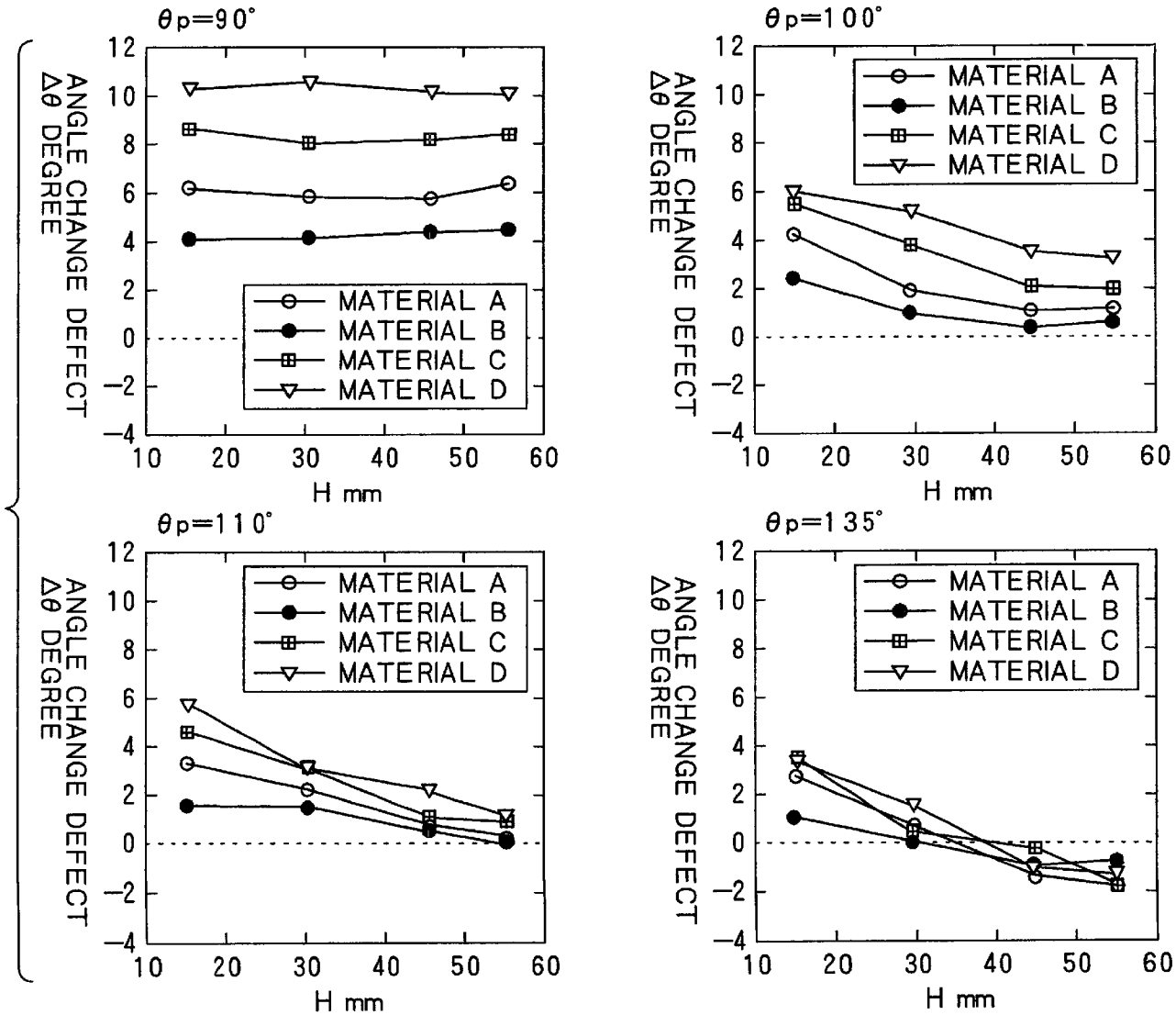
FIG. 19 is a graph showing relationships of materials (steel plates), θp, the forming height H and the angle change defect Δθp of the L-shaped member.
Figure 20:
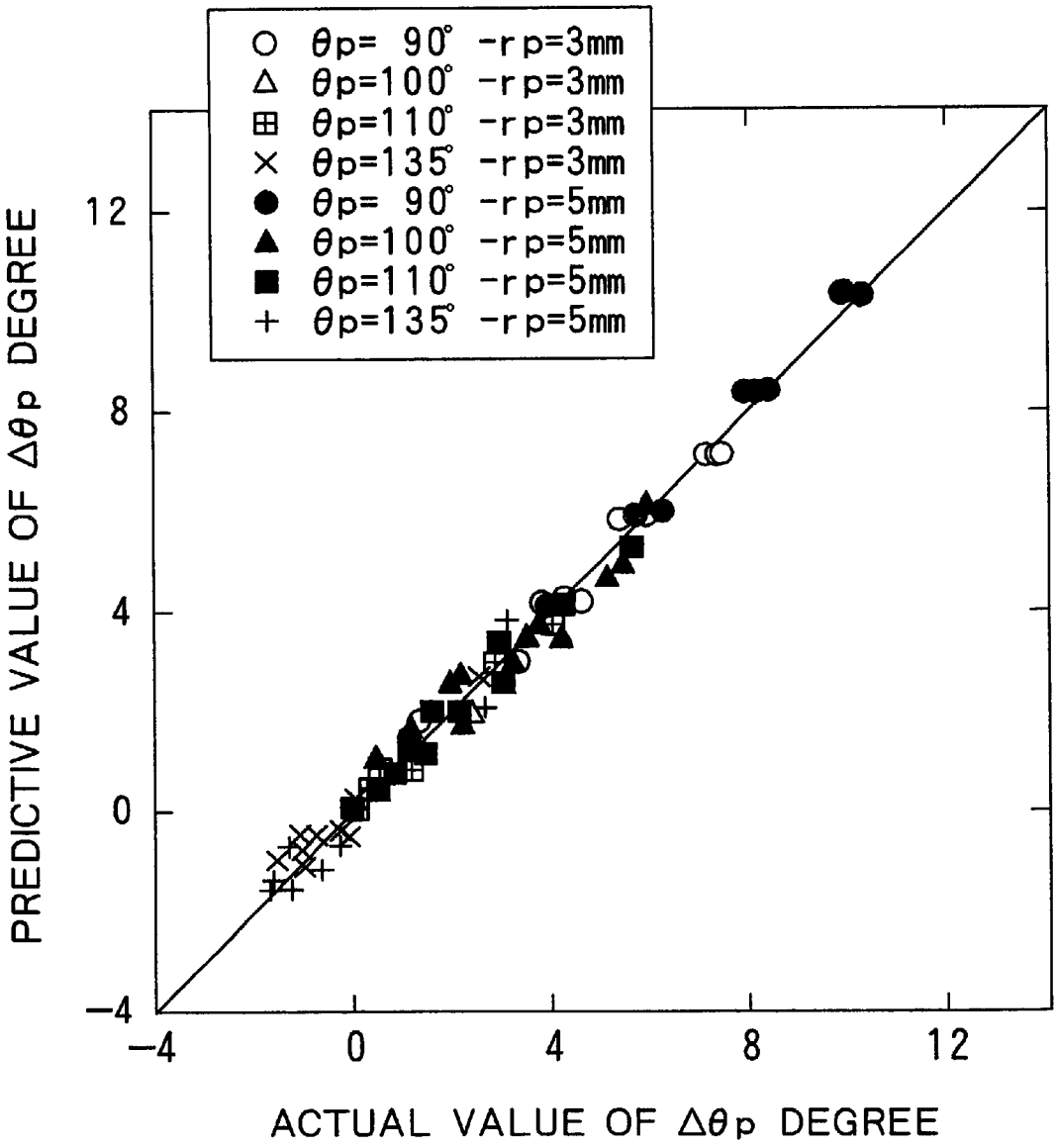
FIG. 20 is a graph showing relationships of the predictive values and actual values of Δθp obtained by the formula (1) of the L-shaped member.
Figure 21:
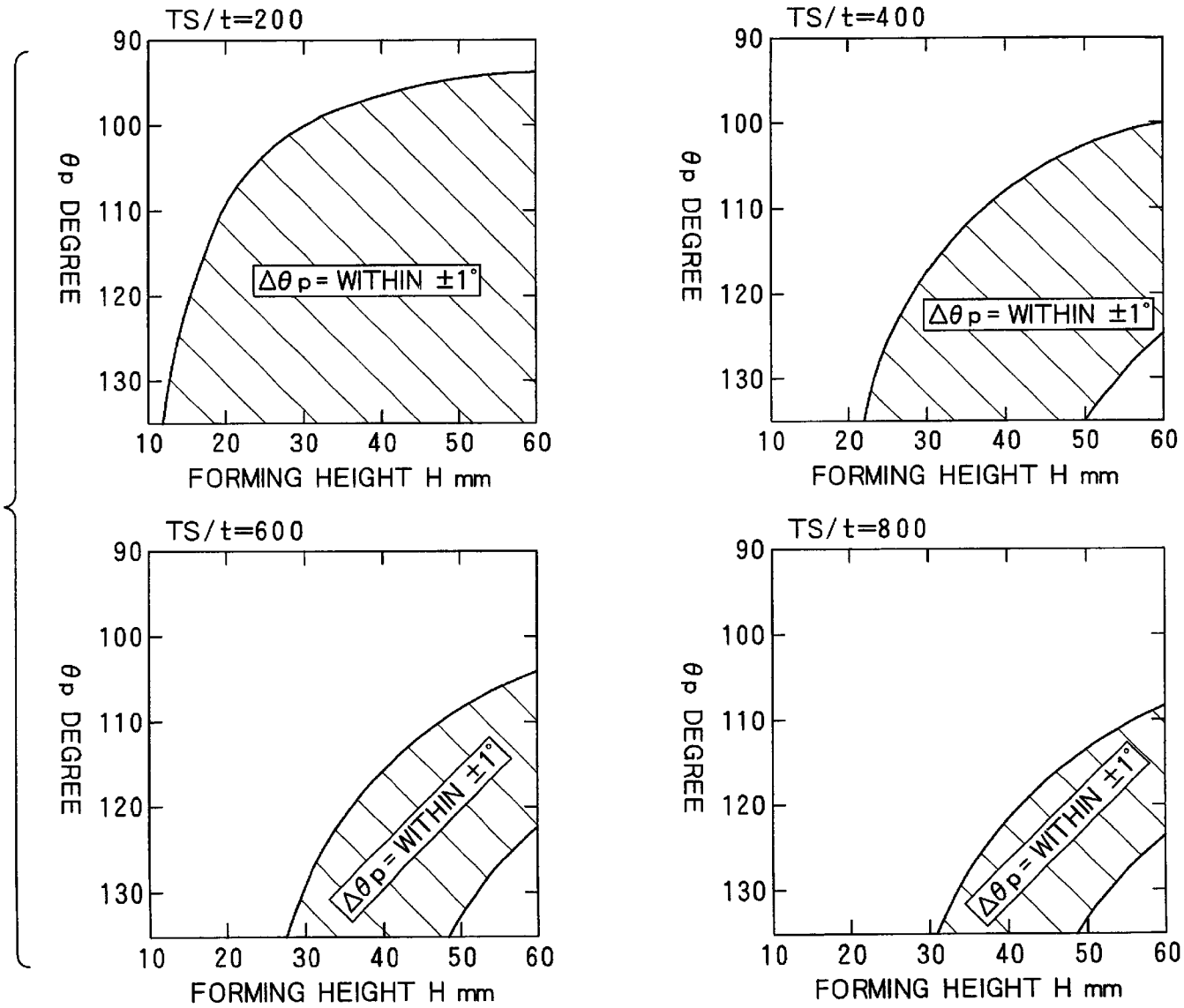
FIG. 21 is a graph showing a range of H and θp where the predictive value of Δθp obtained from the formula (1) of the L-shaped member is ±1°.

First, as shown below, four kinds of steel having different tensile strength TS and thickness t of different materials A to D are bent to form a member by varying θp and a target forming height H of the L-shaped member while setting a radius rp of a bent forming portion of a forming die to a general value, i.e., 5 mm, and Δθp is measured after removed from the die. Results of the measurement are shown in FIG. 19.

Material A: TS=492 Mpa, t=1.0 mm, TS/t=492

Material B: TS=470 Mpa, t=1.6 mm, TS/t=294

Material C: TS=828 Mpa, t=1.2 mm, TS/t=690

Material D: TS=1008 Mpa, t=1.2 mm, TS/t=840

As seen from FIG.19, by increasing θp and H regardless of the tensile strength of the steel plate, Δθp becomes increasingly small in a rapid pace. For example, when θp=110° and H=60 mm, it is possible to achieve Δθ≦1° regardless of what kind of material is used. Moreover, when θp=135°, there is a value for H that turns Δθp to a negative value. This is due to crushing of the arch portion described earlier. When rp=3 mm, a similar result to the above was obtained.

Based on the above-described results, relationships of Δθp, θp, rp, H and material characteristics (TS, t) are formulated, and constants in the formula were determined so as to give accurate prediction based on the actual values. Accordingly, the formula (1) was obtained. Prediction accuracy of the prediction formula is shown in FIG. 10, and it can obtain high accuracy.

$$\Delta\theta p = TS/t\{c - a\cdot H^{(b1\cdot TS/t+b2)}\cdot(\theta p-90)^n\}\times\{1+\exp(d\cdot rp)\}\cdot(rp+0.5t)/\{f\cdot(5+0.5t)\} \quad (1)$$

where a, b1, b2, c, d, f, n are constant values, and each has the following value:

$a=6.663\times10^{-4}$, $b1=-4.992\times10^{-5}$, $b2=0.5067$, $c=0.01240$, $d=-0.1012$, $f=1.6029$, $n=0.3167$.

Figure 11:
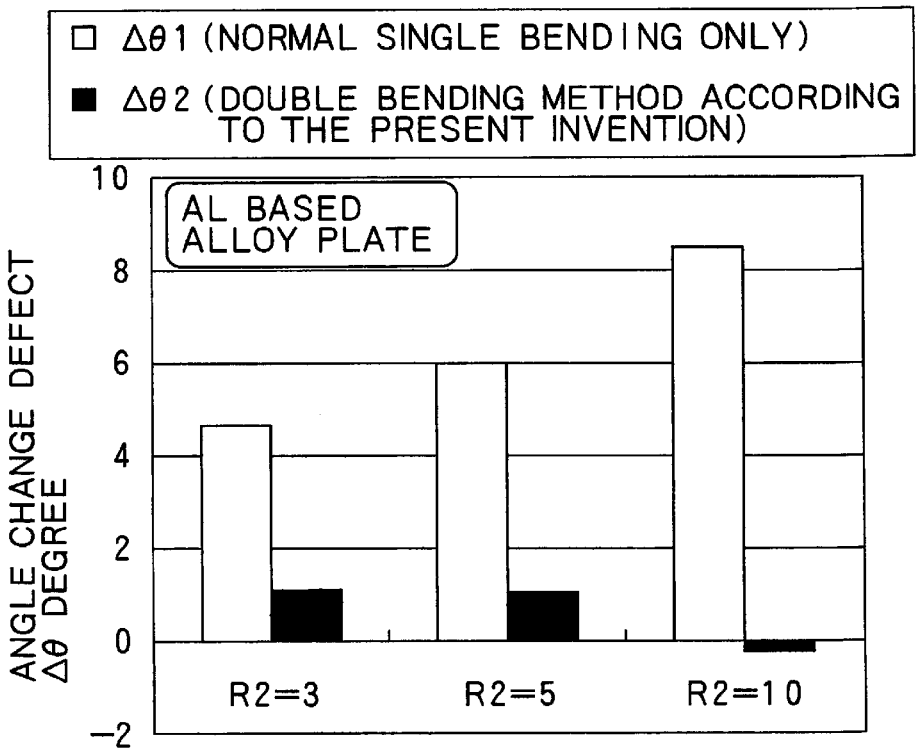
FIG. 11 is a graph comparing the angle change defect Δθ of the conventional single bending forming and the double bending method for the aluminum based alloy plate for cases where R2 are set to 3, 5, and 10 mm.

From the above predictive formula (1), range for θp and H for achieving Δθp=±1° were obtained for each steel plate having material characteristics of TS/t=200, 400, 600, 800 (MPa/mm) with rp=5 mm. The results are shown in FIG. 11. FIG. 11 shows range that enables to suppress the angle change defect Δθp to within ±1° by determining a shape of forming die and a shape of target product within the range.

As shown in FIG. 19, when θp=90°, Δθp does not change much even if a value of H is increased. However, when θp≧110° or more and H is 30 mm or more, every material from A to D maintains Δθp at almost ±3°. Accordingly, in order to fully utilize the effect of improving the angle change defect by crushing the arch portion, it is preferable to have the following values: θp≧110° and H≧30 mm.

Figure 22:
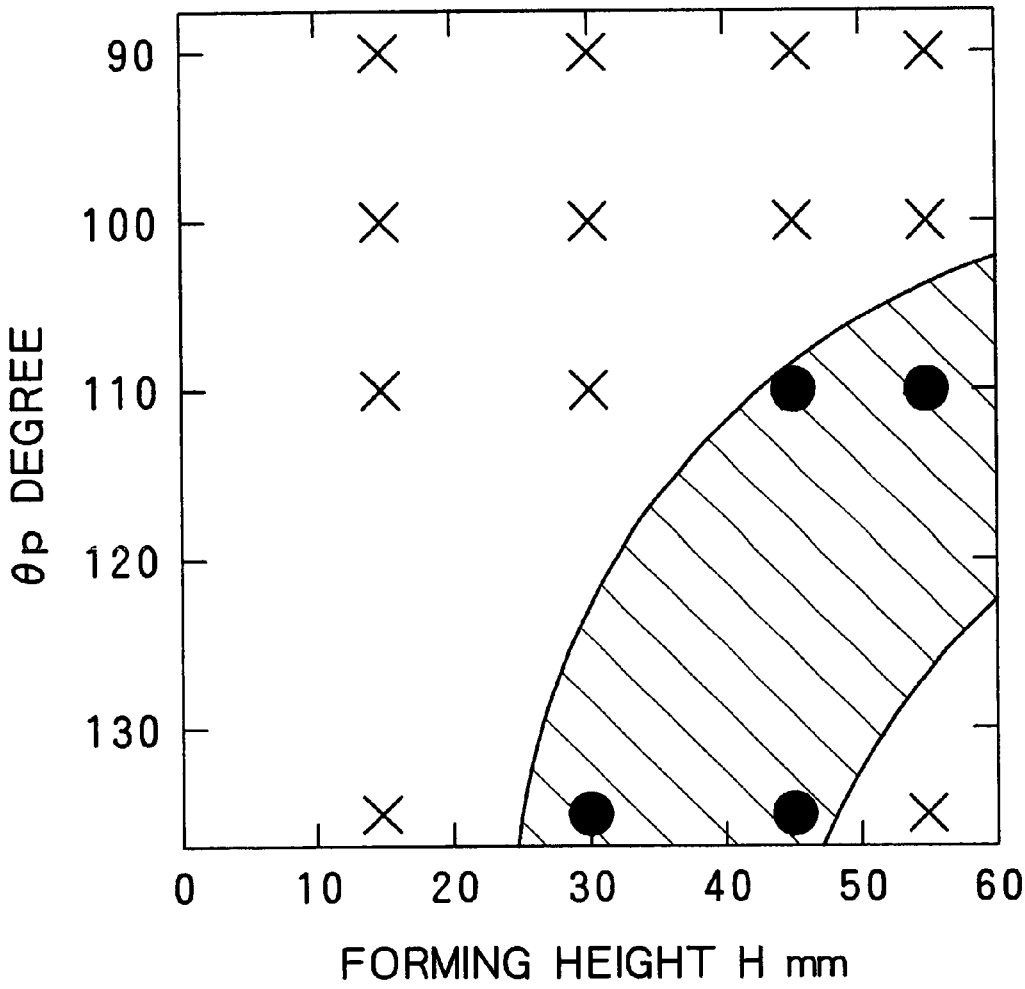
FIG. 22 is a graph showing a range of H and θp where the predictive value of Δθp obtained from the formula (1) of the L-shaped member is ±1° and the state of forming obtained as a result of forming a member with various combination of values for θp and H, where ● show actual values within the acceptable range while X show actual values outside the acceptable value.

Next, in order to check the effect of improving the angle change defect according to the above predictive formula (1), an L-shaped member is formed by bending while changing values for θp and the forming height H by using a material E of a steel plate having the following condition: t=1.2 mm, TS/t=520 MPa/mm. The result is shown in FIG. 22. In the figure, an area with diagonal lines therewithin represents values where Δθp=±1° can be achieved by using the predictive formula. A symbol ● in the figure show combinations of θp and H for realizing Δθp=±1°, and X represents combinations thereof that could not achieve Δθp=±1°. As shown in FIG. 22, the area within Δθp=±1° obtained by the predictive formula has about the same accuracy by actual forming of the member.

As described above, by forming a member by using a forming die having θp and rp obtained by the predictive formula (1) so as to obtain θp, rp and H that has Δθp within the acceptable range, it is possible to obtain an L-shaped member with its Δθp within the acceptable range. The forming height H for the L-shaped member can be obtained by adjusting a size of a metal plate so as to obtain a target value for H. It is needless to say that a vertical distance between the upper flat forming portion 104 of the forming die 101 and the flange forming portion 107 needs to be greater than the forming height H of the L-shaped member 120 so that the inclined flat portion 123 of the L-shaped member 120 is formed to the lower end thereof within the forming surface of the inclined flat forming portion 106.

The θp and rp give a dimension for required forming portion of the forming die, but also gives a target shape of the L-shaped member where Δθp s within the acceptable range. Therefore, the predictive formula may be used for determining a target (product) shape of the formed member.

Moreover, the above description is for the L-shaped member, but it can be also applicable to a bent portion of the U-shaped member where the L-shaped member is placed symmetrically. When forming the U-shaped member, forming target shape is symmetrical, and inclined flat portions of right and left sides are press-formed simultaneously. Therefore, the pad used for placing and holding the metal plate on the upper flat forming portion of the forming die may be optional.

Next, bent forming of a Z-shaped member (FIG. 13B) will be described according to the present invention.

When forming by bending the Z-shaped member according to the present invention, the forming die shown in FIG. 14 may be used to the case of the L-shaped member likewise. A flange forming portion 107 of the forming die 101, the bent forming portion 109 of the forming punch 102, and the flange forming portion 110, all of which were not necessary when forming the L-shaped member, are used for forming the flange portion 135 of the Z-shaped member 130, and a vertical distance between the upper flat forming portion 104 of the forming die 101 and the flange forming portion 107 is the same as the forming height H of the Z-shaped member 130. Lengths of the flange-forming portion 107 for the forming die 101 and the flange forming portion 110 of the forming punch 102 relative thereto are equal to or more than a length Lf of the flange of the Z-shaped member 130. When forming the Z-shaped member 130, an angle θp formed between the upper flat forming portion 104 of the forming die 101 and the inclined flat forming portion 106 is set to θp>90° in order to realize the final phase of forming described later. The method according to the present invention for forming the Z-shaped member can obtain a target shape of the formed member directly and as much as possible from a shape of the forming portion of the forming die, and therefore, same reference symbols (θp, rp and the like) represent the forming factors of the forming portion of the forming die and shaping factors of the formed member.

According to the method of the present invention for bending a member, as shown in FIG. 14, one end of the metal plate W is pressed and held between the upper flat forming portion 104 of the forming die 101 and the pad 103, and by lowering the forming punch 102 toward the forming die 101, the other end of the metal plate W is bent along the bent forming portion 105 of the forming die 101, the inclined flat forming portion 106, and the flange forming portion 107 so as to obtain the Z-shaped member 30 shown in FIG. 13B.

Figure 23A:
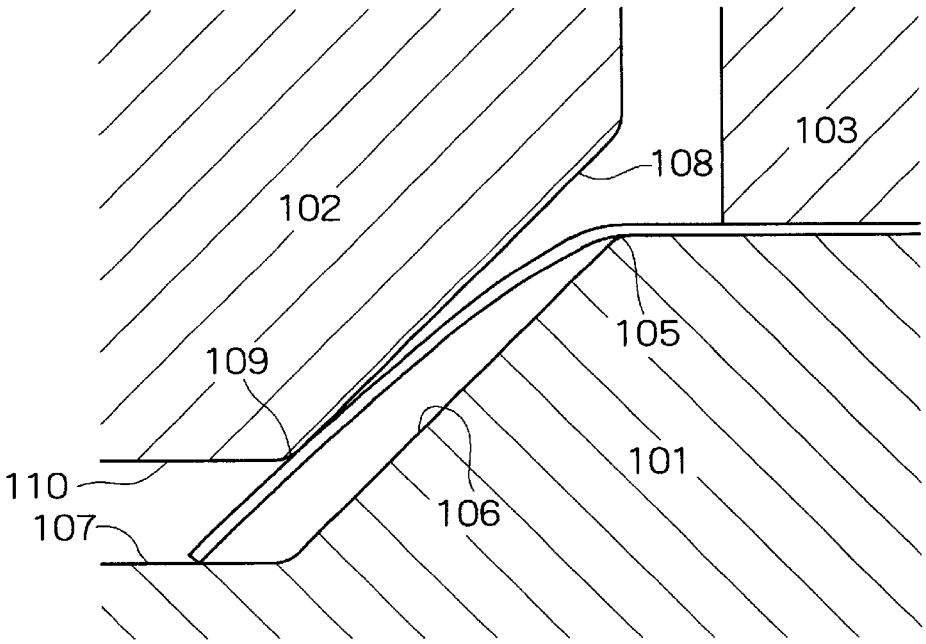
FIG. 23 is a cross sectional view illustrating the middle and final phases of forming in forming the Z-shaped member according to the present invention.
Figure 23B:
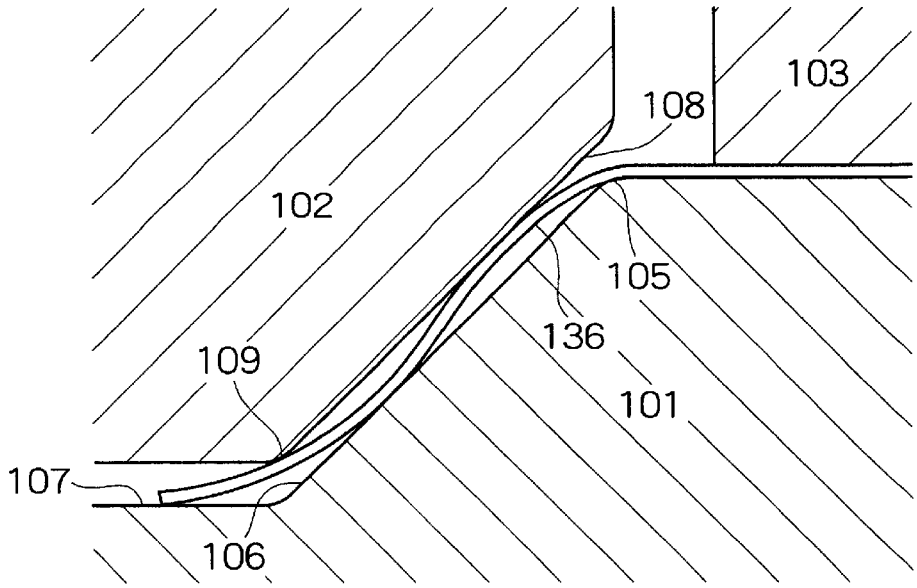

Important aspects for bending the members in the present embodiment come to the middle and final phases of forming. FIG. 23A shows formed members in a middle phase of forming, in which the metal plate W is bent by lowering the forming punch 102 toward the forming die, bending the forming punch 102 round the bent forming portion 105 of the forming die 101, and an open end of the metal plate W abuts with the flange-forming portion 107 of the forming die 101. After the open end of the metal plate W abuts with the flange-forming portion 107, the forming punch 102 is lowered further so that the metal plate W of the open end side receives bending for bending-back force from the bending forming portion 109 of the forming punch 102. Curvature is generated to the inclined flat portion of the Z-shaped member due to the bending for bending-back force. However, an amount of bending for bending-back in deformation can be reduced compared to a conventional case where θp=90°, because of less area for receiving the bending for bending-back force, and of smaller bending angle of the metal plate W at the bent portion 109 of the forming punch 102. In the final phase of forming, the metal plate W is bent in an arch shape round the bending forming portion 105 of the forming die 101, and the bent arch portion 136 comes to contact with the inclined flat forming portion 108 of the forming punch 102, the inclined flat forming portion 106 of the forming die 101 in that order as the forming punch 102 is lowered, as shown in FIG. 23B. A state where the arch portion is abutting with both inclined flat-forming portions 108 and 106 continues for a certain period of time. In the final phase of forming, the arch portion 136 is completely crushed by the inclined flat forming portion 108 of the forming punch 102 while being interposed between the inclined flat forming portion 108 of the forming punch 102 and the inclined flat forming portion 106 of the forming die 101. Before removed from the die, a bending moment −M is generated to the arch portion 136 in a direction of canceling out the bending moment +M for causing the angle change defect to the bent portion 132 of the Z-shaped member 130 and the inclined flat portion 133, thereby an amount of opening ΔW on a lower end of the inclined flat portion 133 before and after removed form the die can be suppressed. Therefore, by setting θp of the forming die 101 appropriately, it is possible to suppress the opening amount ΔW (a horizontal distance between the formed shape after removed from the die and the lower end of the inclined flat portion 133 in the target formed shape) within the acceptable range.

Next, conditions for a size of the forming die (a target shape of a formed member) that suppresses ΔW as much as possible will be described.

Figure 24:
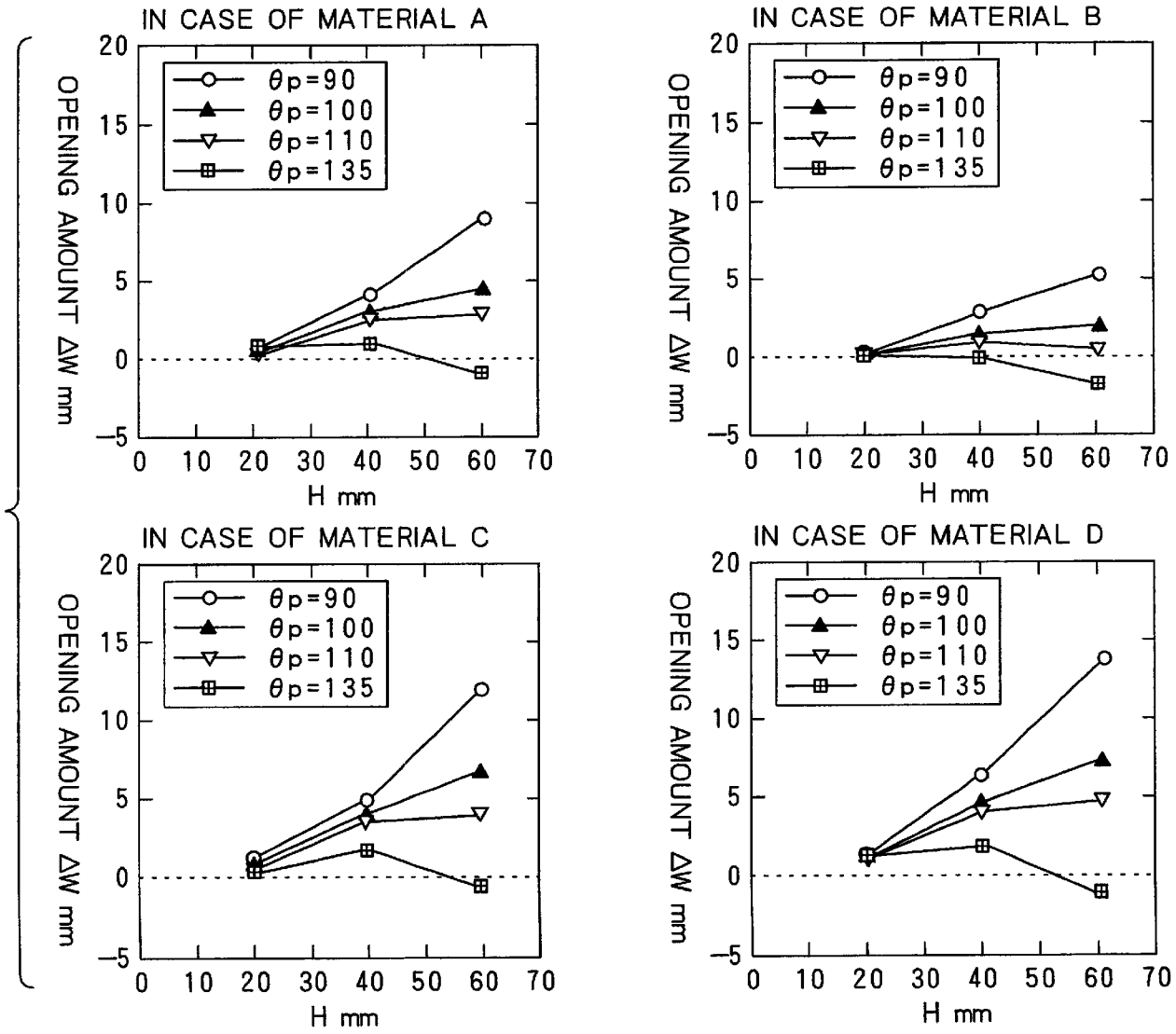
FIG. 24 is a graph showing relationships of materials (steel plates), θp, the forming height H and the opening amount ΔW of the Z-shaped member.
Figure 25:
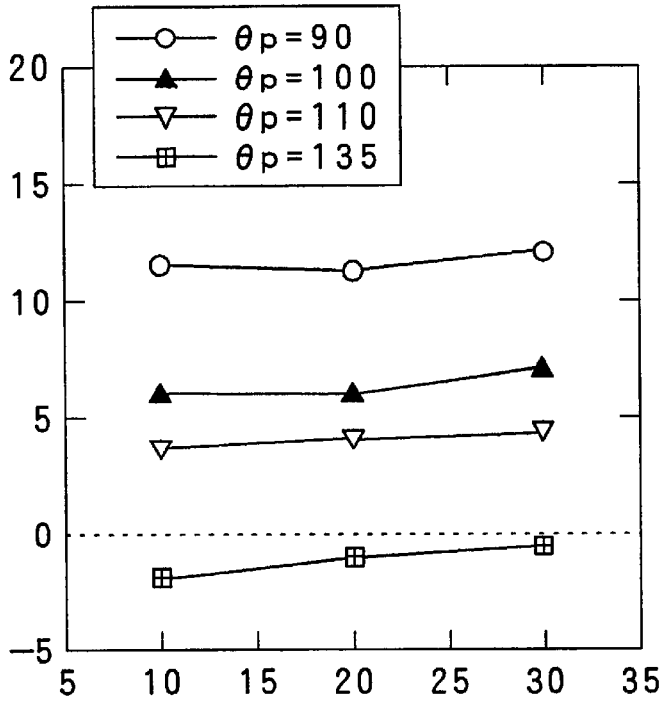
FIG. 25 is a graph showing relationships of various θp, length of the flange portion Lf, and the opening amount ΔW of the Z-shaped member.
Figure 26:
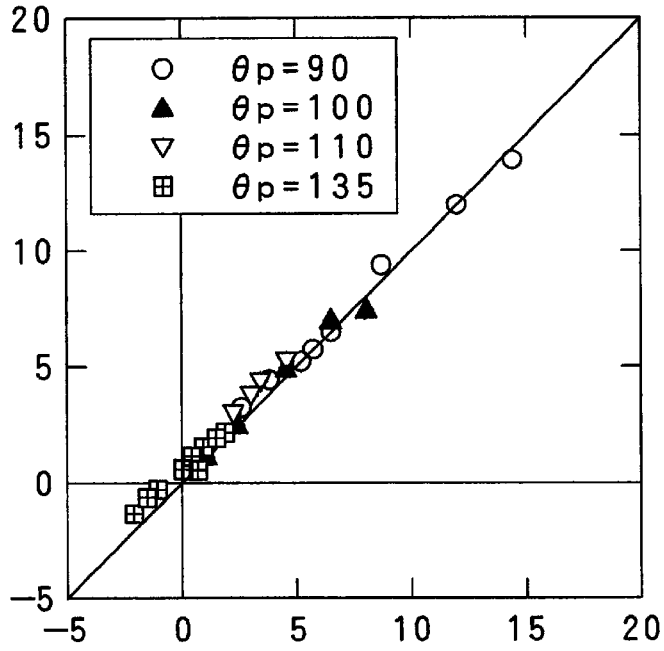
FIG. 26 is a graph showing relationships of predictive values and actual values of ΔW obtained from the formula (2) of the Z-shaped member.

First, the same as bent forming of the L-shaped member, four kinds of steel having different tensile strength TS and thickness t of different materials A to D are bent to form a member by varying θp and a target forming height H of the Z-shaped member while setting a length Lf of the flange portion to 20 mm, and ΔW is measured after removed from the die. Moreover, in order to study the influence of Lf, the member is formed by bending while changing θp, and Lf to various values when setting H=60 mm by using the material C, and ΔW is measured. At this time, radius rp and rd of the forming die and the bending forming portion of the forming punch, respectively, is judged to give little effect on the shape defect from a study given under θp=90° (Dai 51-kai Sosei-Kako Rengo Kouen Kai, Kouen Ronbun Shu, pp113 to 114, Nihon Sosei Kako-Gakkai, November 2000), and therefore, they are set to 5 mm, that is a generally used bending radius. FIGS. 24 and 25 show the result thereof.

As shown in FIG. 24, it can be found that ΔW can be rapidly reduced as increasing θp regardless of the tensile strength of the steel plate. Also, where θp=90°, 100°, when H is increased, ΔW is also increased. This is because increasing the H increases an area for receiving the bending-back force at the inclined flat portion of the Z-shaped member, and also increases effect of Δθp at the bent portion on a proportional basis. On the other hand, where θp=110°, 135°, there are cases where ΔW decreases even when H is increased, and even a case where ΔW<0. This proves that crushing of the arch portion generated during the bent forming works effectively.

As shown in FIG. 25, it is proved that ΔW tends to increase slightly as Lf increases, but Lf has relatively little influence to ΔW.

Based on the above-described results, relationships of ΔW, θp, H, Lf and material characteristics (TS, t) are formulated, and constants in the formula were determined so as to give accurate prediction based on the actual values. Accordingly, the formula (2) was obtained. Prediction accuracy of the predictive formula is shown in FIG. 16, and it shows high accuracy.

$$\Delta W=a\cdot(TS/t)\cdot H^{2}-b\cdot(\theta p-90)^{n0}\cdot H^{(n1\cdot TS/t+n2)}+(c\cdot H+d)\cdot Lf \qquad (2)$$

where a, b, c, d, n0, n1, n2 are constant values, and each has the following value:

$a=4.380\times10^{-6}$, $b=4.739\times10^{-6}$, $c=0.001241$, $d=-0.02411$, n0=0.6, n1=$0.3186\times10^{-3}$, n2=2.841.

Figure 27:
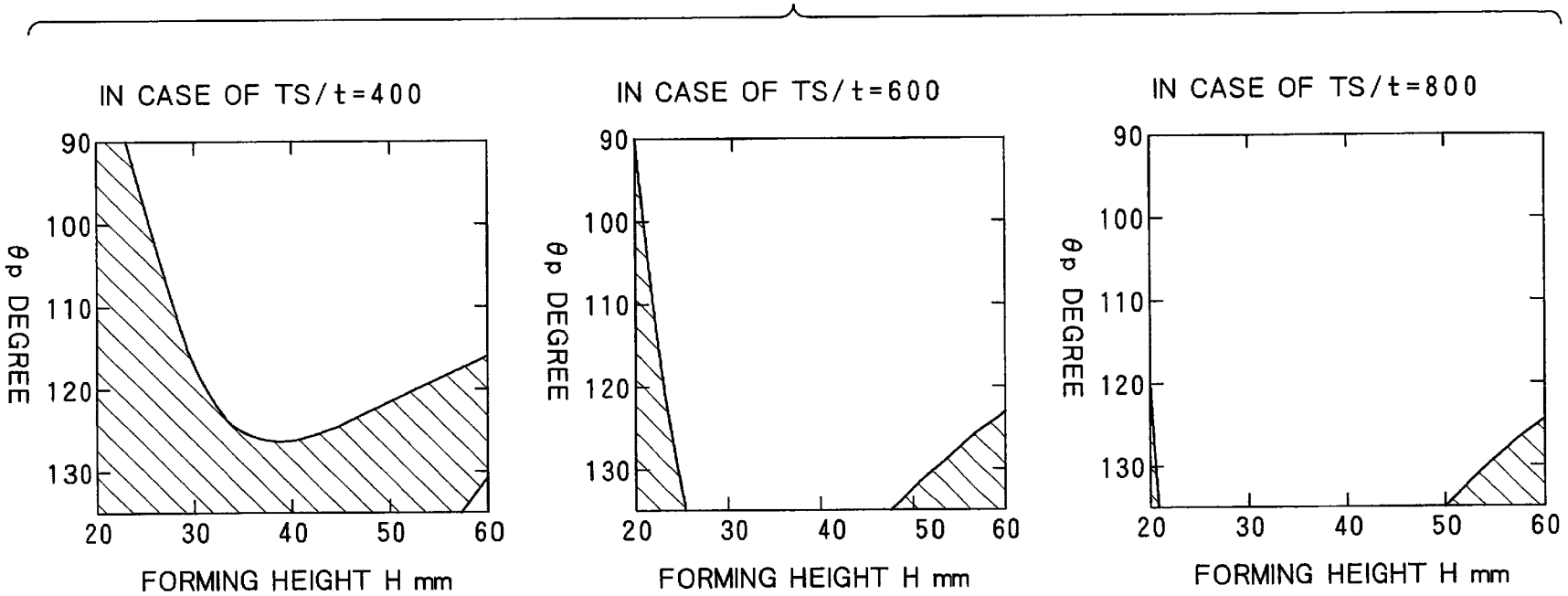
FIG. 27 is a graph showing a range of H and θp where the predictive value of ΔW obtained from the formula (2) of the Z-shaped member is ±1 mm.

From the above predictive formula (2), range for θp and H for achieving ΔW=±1 mm were obtained for each steel plate having material characteristics of TS/t=400, 600, 800 (MPa/mm), rp=rd=5 mm, and Lf=20 mm. The results are shown in FIG. 27. FIG. 27 shows a range that enables to suppress the opening amount ΔW to within ±1 mm by determining a shape of the forming die and a shape of target product within the range.

As shown in FIG. 24, where θp=90°, and 100°, ΔW increases as a value of H is increased. However, when θp≧110°, ΔW increases at slower pace or even starts to decrease when H≧40 mm. When comparison is made at H=60 mm where the decreasing effect of ΔW is most obvious, ΔW at θp≧110° is half of ΔW obtained at θp=90°. And when ΔW at θp=135°, ΔW becomes almost 0 mm. When a member is formed by using the material D having the highest strength while setting values to H=60 mm, θp=110°, ΔW is 5 mm. The result is the same as that of a case where a member is formed by a mild steel plate having the same thickness as that of the D steel. And it is within the acceptable range in terms of accuracy of the size. Accordingly, when forming a Z-shaped member by bending, it is preferable to have the following values: θp≧110° and H≧40 mm, and this is also applied to hat-channel shaped member.

Figure 28:
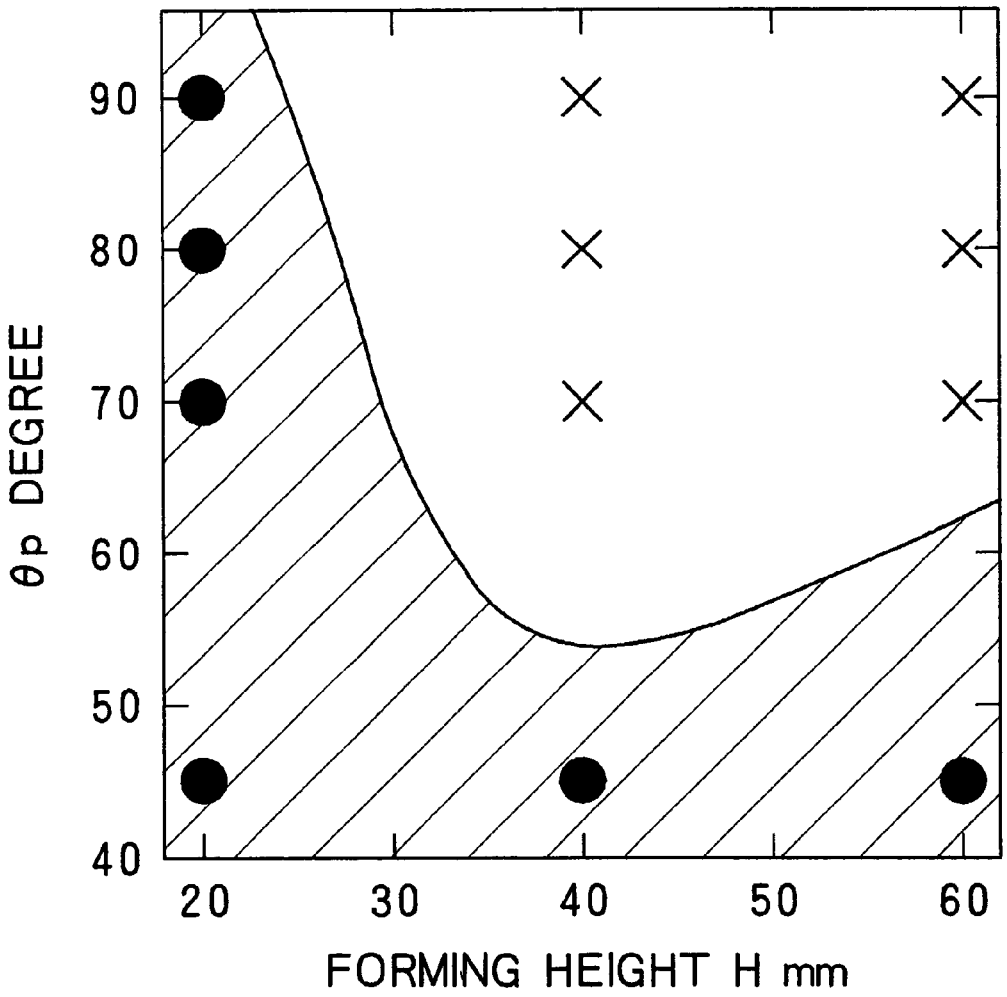
FIG. 28 is a graph showing a range of H and θp where the predictive value of ΔW obtained from the formula (2) of the Z-shaped member is ±1.5 mm and the state of forming obtained as a result of forming a member with various combination of values for θp and H, where ● show actual values within the acceptable range while X show actual values outside the acceptable value.

Next, in order to check the effect of improving the ΔW according to the above predictive formula (2), a Z-shaped member is formed by bending while changing values for θp and the forming height H by using a material E of a steel plate having the following condition: t=1.2 mm, TS/t=520 MPa/mm, and Lf is set to 20 mm. The result is shown in FIG. 28. In the figure, an area with diagonal lines therewithin represents range where ΔW=±1.5 mm can be achieved by using the predictive formula. A symbol ● in the figure show combinations of θp and H for realizing the area within ΔW=±1.5 mm, and X represent combinations thereof that could not achieve the area within ΔW=±1.5 mm. As shown in FIG. 28, the area within ΔW=±1.5 mm obtained by the predictive formula has about the same accuracy as actually forming a member.

As described above, by forming a member by using a forming die having θp and H obtained by the predictive formula (2) so as to obtain ΔW within the acceptable range. A length between the flange forming portion of the forming die 101 and the flange forming portion of the forming punch is made longer than a length of the flange portion Lf so that the flange portion 135 of the Z-shaped member 130 is formed to the opening end thereof.

The θp and H give dimension for required forming portion of the forming die, but also give a target shape of the Z-shaped member where ΔW is within the acceptable range. Therefore, the predictive formula (2) may be used for determining a target (product) shape of the Z-shaped member.

Moreover, the above description is for the Z-shaped member, but it may be also applicable to a bent portion of the hat-channel shaped member where the Z-shaped members are placed symmetrically. When forming the hat-channel shaped member, forming target shape is symmetrical. Therefore, like in a case of the bent forming in the U-shaped member, the pad used for placing and holding the metal plate on the upper flat forming portion of the forming die may be optional.

The metal place to which the present invention is applicable is not limited to steel plate and alternatively, an aluminum based alloy plate may be used. A pressing device used for the present invention is not limited to anything specific, and may also be applicable to an oil hydraulic press, a mechanical press, an opposed hydraulic press and the like.

The foregoing invention has been described in terms of preferred embodiments. However, those skilled, in the art will recognize that many variations of such embodiments exist. Such variations are intended to be within the scope of the present invention and the appended claims.

What is claimed is:

1. A method for bending a metal plate, comprising:

a first forming step for obtaining a first formed member having a bent portion obtained by bending a metal plate; and a second forming step for bending the bent portion of the first formed member, held by a first flat forming portion of a forming die, the forming die having a bent portion which connects with a second flat forming portion of the forming die at a bend stop point, in the same direction as a bending direction of the bent portion, so that the bent portion of the first formed member receives a bending-back force, wherein in the second forming step, a part of the bent portion of the first formed member abuts with the bend stop point.

2. A method for bending a metal plate, comprising:

a first forming step for bending a metal plate by relatively moving a first forming punch from a first flat forming portion to a first forming die with a second flat forming portion formed therein, through a bent forming portion having a radius R1, to thereby obtain a first formed member in which a first flat portion and a second flat portion are coupled with each other through the thus formed bent portion by the bent forming portion; and a second forming step for relatively moving a second forming punch from the first flat forming portion to a second forming die with a second flat forming portion formed therein, through a bent forming portion having a radius R2, to thereby bend the first formed member by the bent forming portion of the second forming die, wherein the second forming step further comprises a substep for placing the second flat portion of the first formed member on the second flat portion side of the second forming die, so that the bent portion of the first formed member receives a bending-back force while abutting with at least one of the bent forming portion and the second flat forming portion, both of the second forming die, wherein in the second forming step, a part of the bent portion of the first formed member abuts with a bend stop point at a second flat forming portion side of the bent portion of the second forming die.

3. A method for bending a metal plate, comprising:

a first forming step for bending a metal plate by relatively moving a first forming punch from a first flat forming portion to a first forming die with a second flat forming portion formed therein, through a bent forming portion having a radius R1, to thereby obtain a first formed member in which a first flat portion and a second flat portion are coupled with each other through the thus formed bent portion by the bent forming portion; and a second forming step for relatively moving a second forming punch from the first flat forming portion to a second forming die with a second flat forming portion formed therein, through a bent forming portion having a radius R2, to thereby bend the first formed member by the bent forming portion of the second forming die, wherein the second forming step further comprises a substep for placing the second flat portion of the first formed member on the second flat portion side of the second forming die, so that the bent portion of the first formed member receives a bending-back force while abutting with at least one of the bent forming portion and the second flat forming portion, both of the second forming die, wherein the method performs the second forming step using following formulas (A) and (B) in which k is obtained from the formula (A), and then ΔW is obtained from the formula (B) by the thus obtained k, $$K=-0.4836\cdot\ln(R2/R1)+0.1817 \quad (A)$$

$$\Delta W=(\pi/2-1)R2+(1-(1-k)\cdot\pi/2)R1 \quad (B)$$

wherein the formulas assume the first formed member to be formed along the first flat forming portion of the first forming die, the bent forming portion, and the second flat forming portion;

a symbol ΔW denotes a distance between the second flat portion of the first formed member and the second flat forming portion of the second forming die; and a symbol k denotes a proportion of the bent portion of the first formed member abutting to the second flat forming portion of the second forming die, to the total length of the bent portion.

4. A method for bending a metal plate, comprising:

a first forming step for bending a metal plate by relatively moving a first forming punch from a first flat forming portion to a first forming die with a second flat forming portion formed therein, through a bent forming portion having a radius R1, to thereby obtain a first formed member in which a first flat portion and a second flat portion are coupled with each other through the thus formed bent portion by the bent forming portion; and a second forming step for relatively moving a second forming punch from the first flat forming portion to a second forming die with a second flat forming portion formed therein, through a bent forming portion having a radius R2, to thereby bend the first formed member by the bent forming portion of the second forming die, wherein the second forming step further comprises a substep for placing the second flat portion of the first formed member on the second flat portion side of the second forming die, so that the bent portion of the first formed member receives a bending-back force while abutting with at least one of the bent forming portion and the second flat forming portion, both of the second forming die, the R1 is set to $R1 \leqq 1.5R2$ when the R2 is 5 mm or more, and to $R1>1.5R2$ when the R2 is less than 5 mm.

5. A method for bending a metal plate, comprising:

a step of preparing a forming die and a forming punch, said forming die having a forming surface in which a horizontal flat forming portion and an inclined flat forming portion being coupled with each other through a bent forming portion, said forming punch being used for bending a metal plate having an inclined flat forming portion parallel to the inclined flat forming portion of the forming die while collaborating with the inclined flat forming portion of the forming die; and a step of bending the metal plate held at the horizontal flat forming portion of the forming die, by using the bent forming portion and the inclined flat forming portion, in such a way that the inclined flat forming portion of the forming punch relatively moves closely or away to/from the inclined flat forming portion of the forming die, wherein in this bending step, an angle formed between the horizontal flat forming portion of the forming die and the inclined flat forming portion is to be obtuse so that a bent arch portion of the metal plate, bent round the bent forming portion of the forming die, abuts simultaneously with both the inclined flat forming portion of the forming punch and the inclined flat portion of the forming die.

6. The method for bending a metal plate according to claim 5, wherein the method uses the forming die that has predetermined θp and rp so as to have Δθp within an acceptable range, Δθp being obtained as a function Δθp of θp, rp, H, TS, t in advance, where TS denotes tensile strength of a metal plate; t, a thickness of the metal plate; rp, radius of a bent forming portion of the forming die; θp, an angle formed between the horizontal flat forming portion of the forming die and the inclined flat forming portion; Δθp, a difference between the θp and an angle formed between the horizontal flat forming portion and an inclined flat portion of the formed member after bending; and H, a vertical distance from the horizontal flat portion to the lower end thereof.

7. The method for bending a metal plate according to claim 6, wherein the method uses, as a function of Δθp, a formula (1) given below:

$$\Delta\theta p = TS/t\{c-1\cdot H^{(b1\cdot TS/t+b2)}\cdot(\theta p-90)^{n}\}\times\{1+\exp(d\cdot rp)\}\cdot(rp+0.5t)/\{f\cdot(5+0.5t)\} \quad (1)$$

where a, b1, b2, c, d, f, n are constant values.

8. The method for bending a metal plate according to claim 6, the θp is set to be 110° or more, and the H is set to be 30 mm or more.

9. The method for bending a metal plate according to claim 5, wherein when bending with a forming die and a forming punch, the forming die having a flange forming portion formed parallel to the horizontal flat forming portion on the other end of the inclined flat forming portion of the forming die, and the forming punch having a flange forming portion formed parallel to the flange portion of the forming die on one end of the inclined flat forming portion of the forming punch, the method uses the forming die that has predetermined θp and H so as to have ΔW within an acceptable range, ΔW being obtained as a function ΔW of θp, H, Lf, TS, t in advance, where TS denotes tensile strength of a metal plate; t, a thickness of the metal plate; θp, an angle formed between the horizontal flat forming portion of the forming die and the including flat forming portion; H, a vertical distance between the flange forming portion and the horizontal flat forming portion of the forming die; and Lf, a length of a flange portion.

10. The method for bending a metal plate according to claim 9, wherein a formula (2) given below is used as a function of $$\Delta W = a\cdot(TS/t)\cdot H^{2} - b\cdot(\theta p-90)^{n0}\cdot H^{(n1\cdot TS/t+n2)} + (c\cdot H+d)\cdot Lf \quad (2)$$

where a, b, c, d, n0, n1, n2 are constant values.

11. The method for bending a metal plate according to claim 9, wherein said θp is set to be 110° or more, and the H is set to be 40 mm or more.

* * * * *

UNITED STATES PATENT AND TRADEMARK OFFICE

CERTIFICATE OF CORRECTION

PATENT NO. : 6,748,788 B2
DATED : June 15, 2004
INVENTOR(S) : Yamano et al.

It is certified that error appears in the above-identified patent and that said Letters Patent is hereby corrected as shown below:

Title page,
Item [73], the Assignee is incorrect, should read -- Kabushiki Kaisha Kobe Seiko Sho (Kobe Steel Ltd.), Kobe (JP) --

Signed and Sealed this

Thirty-first Day of August, 2004

JON W. DUDAS
*Director of the United States Patent and Trademark Office*